US006816183B2

(12) United States Patent
Sasaki

(10) Patent No.: US 6,816,183 B2
(45) Date of Patent: Nov. 9, 2004

(54) RECORDING MEDIUM PACKAGE, FEED CASSETTE AND RECORDING APPARATUS USING THE SAME

(75) Inventor: Yoshiharu Sasaki, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/987,362

(22) Filed: Nov. 14, 2001

(65) Prior Publication Data

US 2002/0057332 A1 May 16, 2002

(30) Foreign Application Priority Data

Nov. 4, 2000 (JP) ..... P2000-346760
Nov. 14, 2000 (JP) ..... P2000-346735

(51) Int. Cl.[7] ..... B41J 2/435
(52) U.S. Cl. ..... 347/262; 347/264
(58) Field of Search ..... 347/139, 153, 347/164, 197, 218, 262, 240, 251, 264, 215, 216, 217, 176; 400/600.3, 645.1; 15/15; 270/58.31, 58.33, 58.34; 271/118, 119; 355/407; 503/227

(56) References Cited

U.S. PATENT DOCUMENTS 3,919,972 A * 11/1975 Komori et al. ..... 271/118
4,932,644 A * 6/1990 Nzei ..... 270/58.33
5,135,905 A * 8/1992 Egashira et al. ..... 503/227
5,754,218 A * 5/1998 Baek et al. ..... 347/240
6,204,874 B1 * 3/2001 Michelson ..... 347/176
6,246,466 B1 * 6/2001 Hirano et al. ..... 355/407
6,365,305 B1 * 4/2002 Taylor, Jr. et al. ..... 430/15

* cited by examiner

*Primary Examiner*—Hai Pham
(74) *Attorney, Agent, or Firm*—Sughrue Mion, PLLC

(57) ABSTRACT

The package of recording media contains a set of recording media which are pre-stacked in a predetermined order is provided to a recording medium holding member so that immediately after the package is opened, the recording media are disposed in a recording apparatus at a time. This package, by avoiding a need of manual stacking of the recording media, lowers a possibility of each recording medium being contaminated with foreign particles so as to reduce resultant image defects. Further, a recording feed cassette stacking the recording media in said manner can achieve the same effect.

22 Claims, 20 Drawing Sheets

1. WRAP IMAGE RECEIVING SHEET TO DRUM

2. WRAP TRAUSTER SHEET (e.g.USE VACAUM CONTACT)

3. LASER RECORDING BY K-DATA

4. STRIP OFF K-SHEET

APPLY SAME MANNER TO C, M AND Y

RECORDING MEDIUM PACKAGE, FEED CASSETTE AND RECORDING APPARATUS USING THE SAME

BACKGROUND OF THE INVENTION

1. Field of the Invention

This invention relates to a package containing a recording medium having an image-receiving sheet and transfer sheets and, more particularly, to a technique for facilitating and ensuring loading a recording apparatus with a set of recording media.

This invention relates to a preset cassette containing a set of recording media consisting of an image-receiving sheet and a plurality of transfer sheets and more particularly to a manner for easily and securely setting recording media in a recording apparatus.

2. Description of the Related Art

One of methods for recording images, letters, etc. comprises fixing an image-receiving sheet as a recording medium combined with a transfer sheet as another recording medium on a rotating drum and exposing the combination to laser light. In this recording system, the image-receiving sheet is wound around the drum with its image-receiving layer outside, while the transfer sheet is superposed thereon with its toner layer in contact with the image-receiving layer. A recording head for exposure reciprocates in the direction parallel with the axis of rotation of the drum while emitting a single laser beam or a plurality of laser beams for scanning exposure. The direction of drum rotation is the main scanning direction, and the moving direction of the recording head is a secondary scanning direction. The drum's rotary motion and head's linear motion are combined appropriately to make a quick scan of the transfer sheet thereby to transfer a desired image onto the image-receiving sheet.

In this recording system, one kind of an image-receiving sheet R and a plurality of kinds of transfer sheets, such as K (black), C (cyan), M (magenta), and Y (yellow), are used. These recording media have been supplied in packages of about 20 to 100 sheets of a kind. For example, as shown in FIG. 36, a stack of about 25 sheets 1 of a kind are vacuum-packed in a packaging material 3, such as a bag of a synthetic resin, e.g., polyethylene, and the bag is packed into a container, such as a paperboard box 5, to make a package 7.

Before starting recording, five packages 7 of different kinds, i.e., an image-receiving sheet R and transfer sheets K, C, M and Y, are opened, and a sheet is taken out of every package and stacked in a cassette in reverse order of recording, e.g., in order of a transfer sheet Y, a transfer sheet M, a transfer sheet C, a transfer sheet K, and an image-receiving sheet R. Thus the cassette has a set of the recording media stacked in order of the image-receiving sheet and the transfer sheets K, C, M and Y from the top. In making a plurality of sets of the recording media, the above operation is repeated.

The cassette 9 having a set of the recording media is fitted to a recording apparatus shown in FIG. 37. The apparatus has a pickup mechanism 13, which picks up the top sheet of the set in the cassette by means of a rubber roller or by suction. The recording medium picked up by the pickup mechanism 13 is transported by a guide plate or roller, etc. (not shown) and fixed on a rotating drum 15.

Upon switching on the recording apparatus 11, the image-receiving layer, which is the top sheet of the set, is fed to the rotating drum 15 and fixed thereon with its image-receiving layer outside. The transfer sheet K is then fed and fixed on the image-receiving sheet with its toner layer facing the image-receiving layer of the image-receiving sheet. Thus, the image-receiving layer of the image-receiving sheet and the toner layer of the transfer sheet are brought into contact. Data of color K are recorded on the combined recording media through a recording head (not shown). After completion of the recording, the transfer sheet K is stripped off the drum 15 and discharged out the recording apparatus 11. These operations of feeding, recording and discharging the recording medium are repeated in succession using each of the transfer sheets C, M and Y to complete transfer of a full-color image to the image-receiving sheet.

Since every recording medium should be taken out of the respective opened packages and stacked in a cassette for making every set of recording media as stated, they are unavoidably exposed to the external environment and are therefore liable to contamination with foreign matter. Contamination with foreign matter can result in a failure of normal recording or formation of image defects such as white spots or ring unevenness.

Besides the problem of contamination, the above work for making a set of recording media, being done manually, involves the possibility of making a set in an erroneous order. Where, for example, the sheets must be stacked in order of RKCMY from the top, an erroneous set of sheets stacked in order of RKCYM results in erroneous recording of data M in color Y and of data Y in color M. Such an error causes a waste of not only material (the erroneously recorded image-receiving sheet) but time. When the recording media are erroneously stacked in order of KRCYM, for another example, the transfer sheet K is used as an image-receiving sheet, which results in absolute failure of recording and waste of material and time.

SUMMARY OF THE INVENTION

An object of the present invention is to provide a package of recording media which saves the trouble for opening all the packages of different recording media used for recording, excludes the manual work for making a set of recording media and, as a result, incurs no image defects due to adhesion of foreign matter nor recording failures due to human errors in making a set of recording media.

The present invention provides a package containing at least one set of recording media consisting of an image-receiving sheet having an image-receiving layer which is fed to a recording medium holding member and a plurality of transfer sheets each having a toner layer which are successively fed to the recording medium holding member so that the toner layer of each transfer sheet may be brought into contact with the image-receiving layer of the image-receiving sheet, the image-receiving sheet and the transfer sheets being stacked in order of feed to the recording medium holding member.

The package of recording media according to the present invention contains a set of recording media which are stacked in order of feed to a recording medium holding member. After the package is opened, the recording media stacked in a set are disposed in a recording apparatus at a time. By use of the package, there is no need any more to manually stack recording media one by one in a recording apparatus. That is, an operator can put a set of recording media in a recording apparatus without touching all of the recording media. As a result, the possibility of each recording medium's being contaminated with foreign matter is reduced to reduce resultant image defects. Further, a recording failure due to an erroneous order of recording never occurs. The package also brings about saving of labor for preparing a set of recording media.

In a preferred embodiment of the present invention, the top sheet of the set of stacked recording media is the image-receiving sheet. When the set of recording media according to this embodiment is put into a recording apparatus, it is the image-receiving sheet that is fed first to a recording medium holding member. Thereafter, the remaining transfer sheets are successively and selectively fed to be superposed on the image-receiving sheet held on the holding member.

In another preferred embodiment of the present invention, the package contains a plurality of sets of recording media, each set consisting of recording media stacked in order of feed to the recording medium holding member. The package of this embodiment makes it possible to load a recording apparatus with a plurality of sets of recording media at a time. On completion of one recording cycle (feed of an image-receiving sheet to a recording medium holding member, transfer of images from each transfer sheet to the image-receiving sheet, and discharge of the recorded image-receiving sheet), an image-receiving sheet of a next set of recording media is fed to start a second recording cycle. That is, as many recording cycles as the sets can be accomplished in a continuous manner.

In another preferred embodiment of the present invention, the image-receiving layer of the image-receiving sheet and the toner layer of each of the transfer sheets face in opposite directions. According to this embodiment, the package makes it possible to superpose each transfer sheet on the image-receiving sheet to bring the image-receiving layer and the toner layer into contact without involving reversal of either the image-receiving sheet or the transfer sheet while being transported. Therefore, the recording media can be fed and transported rapidly in their travel from the cassette to the recording medium holding member.

In another preferred embodiment of the invention, an interleaving sheet is inserted between every adjacent recording media in the package. The interleaving sheet serves as a slip sheet to improve slippage of the recording media. When a recording medium is picked up from the top of the stack, the interleaving sheet helps smooth separation of the upper recording medium from the lower one. As a result, sheet feeding troubles, such as double sheet feeding or a failure of feeding due to blocking of sheets, can be prevented. The interleaving sheet is also effective in protecting the recording media from scratches.

It is preferred that the interleaving sheets extend outward from at least one side of the set of the recording media so that the interleaving sheets may be fixed to the recording apparatus or the cassette body by making use of their extended part (extension). Being fixed, the interleaving sheets can be prevented from coming out when the recording media are fed.

The interleaving sheets preferably have at least one perforation for fixing them to the recording apparatus in their extension. In this embodiment, the interleaving sheets can be easily and securely fixed to the recording apparatus (or the cassette) by some fixing means provided on the recording apparatus (or the cassette).

In a still preferred embodiment of the invention, an interleaving sheet is also inserted between the packaging material of the package and the image-receiving layer of the image-receiving sheet or between the packaging material and the toner layer of the transfer sheet. In this embodiment, since the image-receiving layer of the image-receiving sheet or the toner layer of the transfer sheet is prevented from coming into direct contact with the packaging material, such as a synthetic resin bag, the image-receiving layer or the toner layer is protected from undergoing changes in physical or performance properties due to contact with the packaging material. In addition, any pattern of the synthetic resin bag as a packaging material is prevented from being transferred to the recording media.

In a still preferred embodiment of the invention, the interleaving sheet is made of the same material which constitutes the substrate of the recording media. In this embodiment, a recording medium having no working layer (an image-receiving layer or a toner layer), i.e., only a substrate can be used as an interleaving sheet. As a result, the recording media and the material with which the recording media are brought into contact are of the same quality, and adverse influences of the packaging material can be lessened.

In a still preferred embodiment of the invention, at least the side of the interleaving sheet that is in contact with a recording medium has the same properties or conditions as the side of the recording medium opposite to its image-receiving layer or toner layer side. For example, that side of the interleaving sheet and that side of the recording medium can have the same antistatic coating and approximately the same surface roughness. The antistatic coating secures easy slip, and the similar surface roughness secures the same level of slipperiness.

Another object of the present invention is to provide a preset recording medium feed cassette and a recording apparatus using the cassette which save the trouble for opening all the packages of different recording media used for recording, exclude the manual work for making a set of recording media used for recording and, as a result, incur no image defects due to adhesion of foreign matter nor recording failures due to human errors in preparing a set of recording media.

The present invention provides a recording medium feed cassette comprising a cassette body containing at least one set of pre-stacked recording media consisting of an image-receiving sheet having an image-receiving layer which is fed to a recording medium holding member and a plurality of transfer sheets each having a toner layer which are successively fed to the recording medium holding member so that the toner layer of each transfer sheet may be brought into contact with the image-receiving layer of the image-receiving sheet, the image-receiving sheet and the transfer sheets being stacked in order of feed to the recording medium holding member.

The cassette according to the present invention contains a set of preset recording media which are stacked in order of feed to a recording medium holding member. By use of the cassette, a recording apparatus can be loaded with a set of necessary recording media at a time, and there is no need any more to manually set recording media one by one. That is, an operator can put a set of recording media in a recording apparatus without touching all of the recording media. As a result, the possibility of each recording medium's being contaminated with foreign matter is reduced to reduce resultant image defects. Further, a recording failure due to an erroneous order of recording never occurs. The cassette also brings about saving of labor for preparing a set of recording media.

In a preferred embodiment of the present invention, the recording medium feed cassette contains a plurality of sets of recording media which are pre-stacked, each set consisting of recording media stacked in order of feed to the recording medium holding member. The cassette of this embodiment makes it possible to load a recording apparatus with a plurality of sets of recording media at a time. On completion of one recording cycle (feed of an image-receiving sheet to a recording medium holding member, transfer of images from each transfer sheet to the image-receiving sheet, and discharge of the recorded image-receiving sheet), an image-receiving sheet of a next set of recording media is fed to start a second recording cycle. That is, as many recording cycles as the sets can be accomplished in a continuous manner.

In another preferred embodiment of the invention, the image-receiving layer of the image-receiving sheet and the toner layer of each of the transfer sheets face in opposite directions. According to this embodiment, the cassette makes it possible to superpose each transfer sheet on the image-receiving sheet to bring the image-receiving layer and the toner layer into contact without involving reversal of either the image-receiving sheet or the transfer sheet while being transported. Therefore, the recording media can be fed and transported rapidly in their travel from the cassette to the recording medium holding member.

In another preferred embodiment of the invention, an interleaving sheet is pre-inserted between every adjacent preset recording media in the cassette. The interleaving sheet serves as a slip sheet to improve slippage of the recording media. When a recording medium is picked up from the top of the stack, the interleaving sheet helps smooth separation of the upper recording medium from the lower one. As a result, sheet feeding troubles, such as double sheet feeding or a failure of feeding due to blocking of sheets, can be prevented. The interleaving sheet is also effective in protecting the recording media from scratches.

In another preferred embodiment of the invention, an interleaving sheet is pre-inserted between the cassette body and the preset image-receiving layer of the image-receiving sheet which is the uppermost sheet of the set and between the cassette body and the toner layer of the lowermost transfer sheet. In this embodiment, since the image-receiving layer of the image-receiving sheet and the toner layer of the transfer sheet are prevented from coming into direct contact with the cassette body, the image-receiving layer and the toner layer are protected from undergoing changes in physical properties due to migration of chemical substances from the cassette body and in surface roughness.

It is preferred that the interleaving sheets extend outward from at least one side of the set of the preset recording media so that the interleaving sheets may be fixed to the cassette body by making use of their extended part (extension). Being fixed, the interleaving sheets can be prevented from coming out when the recording media are fed from the cassette.

It is still preferred for the interleaving sheets to extend outward from the side of the set of preset recording media which is opposite to the side to be brought into contact with a pickup mechanism of a recording apparatus. In this case, the extension can easily be fixed to the recording apparatus or the cassette. As a result, the interleaving sheets are securely prevented from being drawn out together with a recording medium by the force of the pickup mechanism.

It is also a preferred embodiment that each preset recording medium sticks out from the interleaving sheets in the side where a pickup mechanism of a recording apparatus is applied. Since the pickup mechanism exerts its action only to the sticking part of the recording medium, the interleaving sheet underneath the recording medium is prevented from being dragged together with that recording medium.

In a still preferred embodiment of the invention, the cassette body has a member for fixing the extension of the preset interleaving sheets. The interleaving sheets, being fixed to the cassette body by the fixing member, are securely prevented from being taken out together with the recording medium.

In a still preferred embodiment of the invention, the cassette has a cushioning material for restraining the preset recording media's moving in the cassette body, the cushioning material being interposed between the cassette body and the interleaving sheet put on the top and the bottom of the set of recording media. The cushioning material restrains the recording media's movement in the cassette body through inertia during transportation. It also prevents direct contact of the recording media with the cassette body to protect the recording media against scratches or contamination with dust that may be produced due to friction, etc.

The cushioning material is preferably dust-free sponge. Made of dust-free sponge, the cushioning material hardly generates dust even when the recording media in contact therewith slide by inertia, shocks, etc. Having elasticity, the dust-free sponge can be disposed at a plurality of positions between the cassette body and the set of the recording media in an appropriately compressed state thereby to protect the recording media against damage from shocks.

The cassette body of the preset recording medium feed cassette of the invention is preferably made of metal. Static electricity, if generated by friction among the stacked recording media during transportation, is not accumulated because it is allowed to escape into the metallic cassette body. As a result, the recording media are prevented from clinging to each other due to electrostatic force and thereby from being fed together.

It is also preferred that the preset cassette body be made of paperboard, which is cheap and easy to fabricate to reduce the material cost and the production cost. Paperboard-made cassette bodies, being recyclable, favor to effective utilization of resources and are environmentally friendly.

The preset cassette of the present invention is preferably packaged in an external packaging sheet. The packaged cassette shuts off dust, light, etc. from the outside. As a result, the recording media are protected against adhesion of dust, denaturation of the working layers (i.e., the image-receiving layer and the toner layers), and the like and maintain satisfactory quality for a prolonged period of time.

The cassette packaged in an external packaging sheet is preferably further packaged in a paperboard box so as to protect the external packaging sheet and the cassette from physical damage. Further, even where the cassette body itself has an irregular shape with projections, etc., the paperboard boxes having a rectangular parallelopipedonal shape, etc. are easy to stack up, which improves transportability and space utility.

In another preferred embodiment of the invention, the cassette body has an opening through which each recording medium is picked up and fed, and the opening is covered with a lid such that the opening is closed and opened. With the lid open, the recording media are easily picked up and fed from the cassette body. On opening the lid, the cassette changes from the closed state to a ready-to-feed state very quickly so that probability of dust entering through the opening is minimized.

The lid is preferably detachable from and attachable to the cassette body. The lid which is an obstacle in fitting the cassette to the recording apparatus can be removed before fitting, which is advantageous for easy cassette fitting.

The present invention also provides a recording apparatus comprising a preset recording medium holding member which moves while holding a recording medium thereon and a recording head which moves in the direction perpendicular to the moving direction of the recording medium holding member while irradiating the recording medium with a laser beam spot, wherein the recording apparatus has a cassette holder which supports a recording medium feed cassette containing at least one set of recording media stacked in order of feed to the recording medium holding member, the recording media being fed from the cassette mounted on the cassette holder to the recording medium holding member.

By use of the recording apparatus of the invention, the recording medium feed cassette containing a set of preset recording media stacked in order of feed can directly be set by a quite easy operation. It is no more necessary to make a set of recording media in a conventional cassette. Adhesion of foreign matter to the recording media is reduced. There is no possibility of making a wrong set of recording media. The labor for preparing a set of recording media and disposing the set in a recording apparatus is greatly saved.

BRIEF DESCRIPTION OF THE DRAWINGS

FIGS. 26A and 28B are each a side view showing the positional relationship between a set of recording media and a recording medium holding member.

DESCRIPTION OF THE PREFERRED EMBODIMENTS

Figure 1:
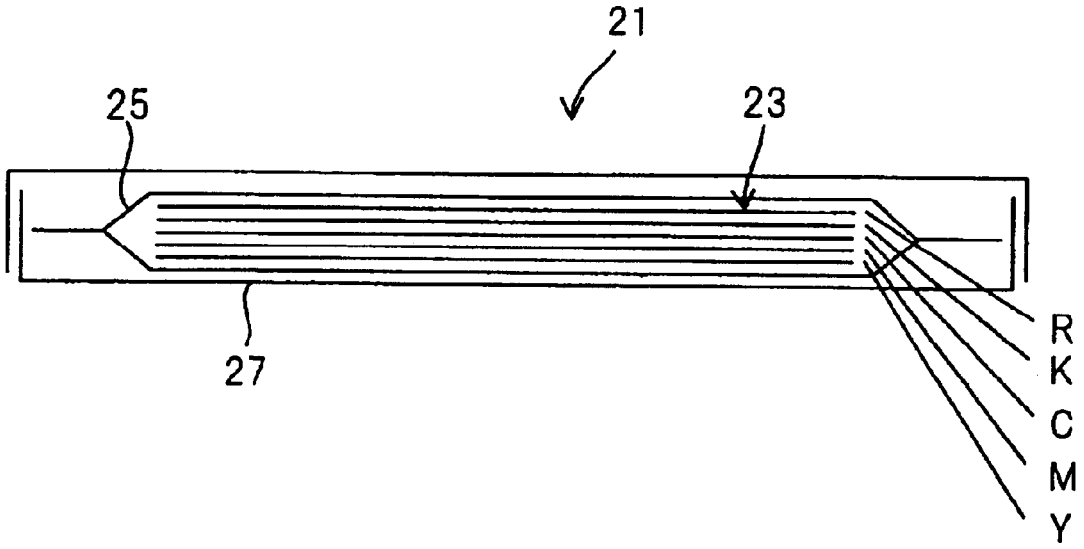
FIG. 1 is a schematic cross-section of a package according to a first embodiment of the invention.
Figure 2:
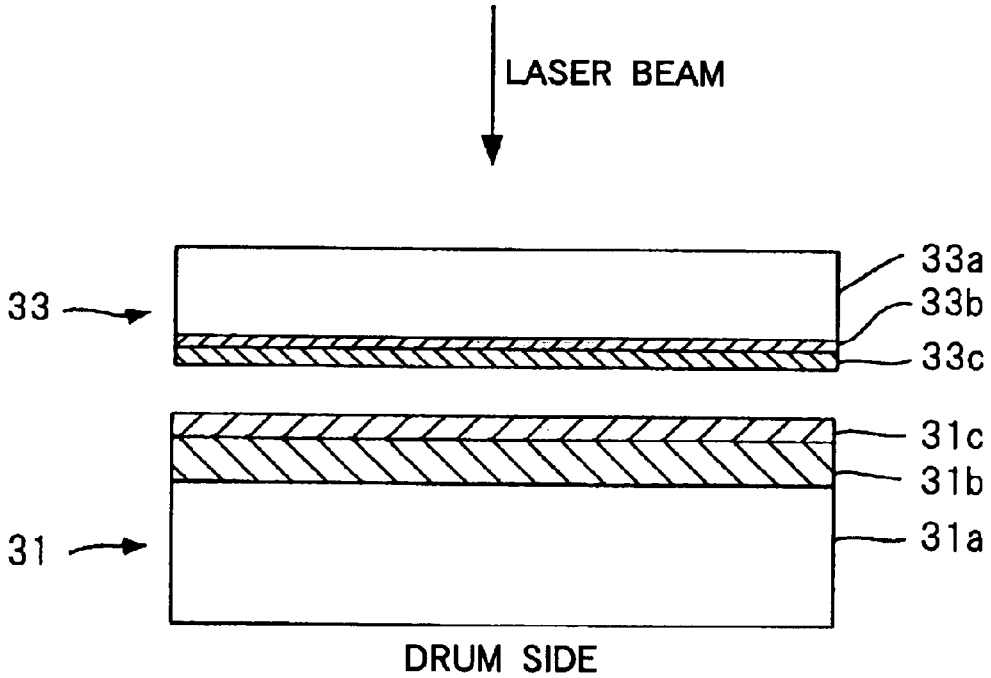
FIG. 2 is a schematic cross-section of recording media being combined for recording.
Figure 3:
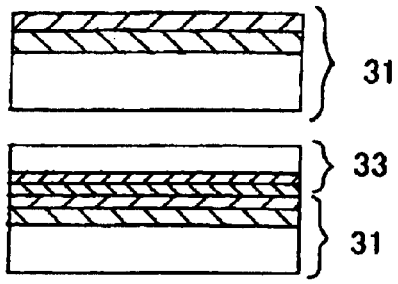
FIG. 3 illustrates the steps for image formation on a image-receiving sheet.
Figure 3:
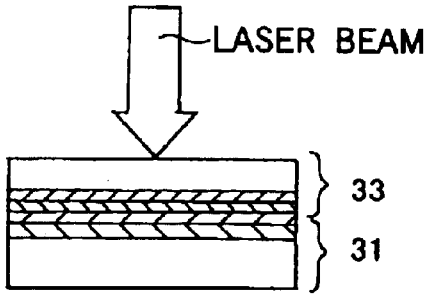
Figure 3:
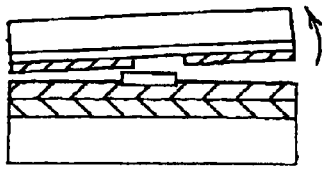
Figure 3:
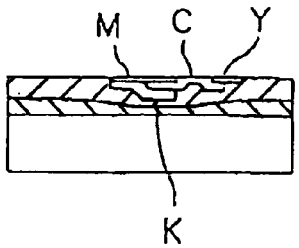
Figure 36:
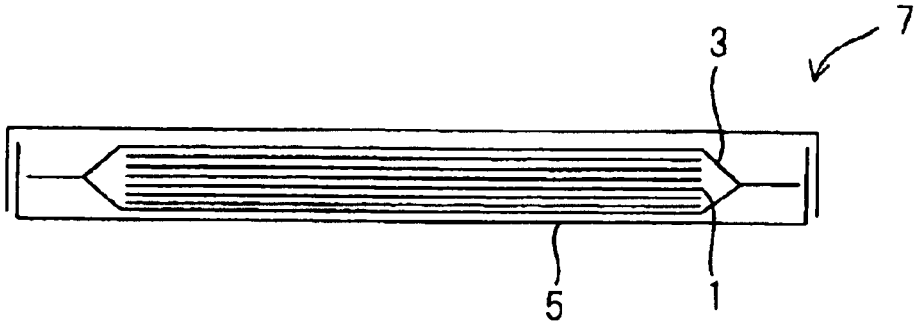
FIG. 36 schematically illustrates the constitution of the recording apparatus according to the present invention.

The present invention will be described in detail with reference to its preferred embodiments by referring to the accompanying drawings. FIG. 1 is a schematic cross-section of a package according to the first embodiment of the invention. FIG. 2 is a schematic cross-section of recording media being combined on a rotating drum. FIG. 3 illustrates the steps for image formation on an image-receiving sheet. The same members as used in FIGS. 36 and 37 are given the same numerals or symbols, and a repetition of description therefor is omitted.

Figure 37:
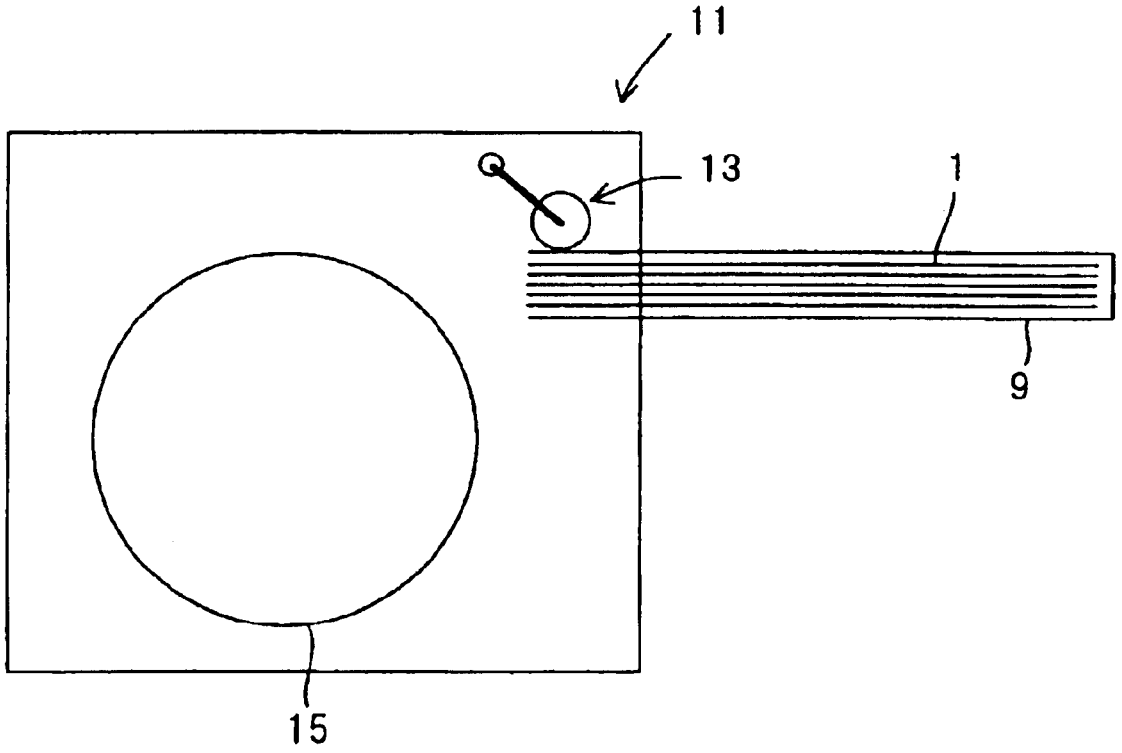
FIG. 37 is a perspective of a recording medium holding member and a recording head of a recording apparatus.

As shown in FIG. 1, a package 21 of the first embodiment contains an image-receiving sheet and transfer sheets as stacked in order of feed to the recording medium holding member 15 (see FIG. 37). Recording apparatus to which the package is applicable include a rotary system in which recording media are wound around a rotating drum, and, while the drum is rotated, the recording media are scanned in the drum axial direction with a moving recording head or a moving laser beam spot from a recording head; and a self-traveling system in which recording media are transported on transport rollers, etc. to a recording position where they are scanned, while being transported, in the direction perpendicular to the transport direction with a moving recording head or a moving laser beam spot from a recording head. A rotating drum used in the rotary system and nip rolls used in the self-traveling system correspond to the recording medium holding member. The recording system using the package of the present invention will be described with particular reference to the rotary system for instance.

Where a stack of the recording media 23 are to be fed to the rotating drum 15 in order of R (image-receiving sheet), K (black transfer sheet), C (cyan transfer sheet), M (magenta transfer sheet), and Y (yellow transfer sheet), they are stacked in order of RKCMY from the top.

The stack of the recording media 23 is vacuum-packed in a packaging material 25, such as a bag of a synthetic resin, e.g., polyethylene, and the bag is put into a container, such as a paperboard box 27, to make a package 21. While every adjacent recording media 23 are in contact with each other, they are depicted with a gap therebetween in FIG. 1 and other similar drawings for the sake of distinction. The order of stacking the recording media 23, i.e., the order of recording includes RKYMC, RYMCK, RCMYK, and the like. It is essential for any order that R be the top sheet to be fed first.

As shown in FIG. 2, the image-receiving sheet 31 comprises a substrate 31*a*, a cushioning layer 31*b*, and an image-receiving layer 31*c* in this order. The substrate 31*a* includes a polyethylene terephthalate film, a triacetyl cellulose film, and a polyethylene naphthalate film. The image-receiving layer 31*c* is a layer for receiving a transferred toner. The cushioning layer 31*b* serves to absorb a level difference in superimposing toner images.

The transfer sheet 33 comprises a substrate 33*a*, photothermal converting layer 33*b*, and a toner layer 33*c* in this order. The substrate 33*a* is arbitrarily chosen from materials commonly used which transmit laser light, such as those useful as the substrate 31*a* of the image-receiving layer 31. The photothermal converting layer 33*b* serves to convert laser light energy into heat. The photothermal converting layer 33*b* is made of a material arbitrarily selected from general photothermal converting materials capable of converting light energy into heat energy, such as carbon, black substances, infrared absorbing dyes, and substances absorbing specific wavelengths. The toner layer 33*c* is made of a black (K) toner, a cyan (C) toner, a magenta (M) toner or a yellow (Y) toner. In some cases, a gold toner layer, a silver toner layer, or a like color toner layer is prepared.

Recording by use of the recording apparatus 11 is carried out as follows. A transfer sheet 33 is superposed on the image-receiving sheet 31 wound around the rotating drum 15. The transfer sheet 33 is exposed to laser light according to image information to be recorded. The toner of the exposed and thus heated part of the transfer sheet 33 is transferred to the image-receiving sheet 31 through toner's loss of adhesiveness, toner's melting or toner's sublimation to form a toner image on the image-receiving sheet 31. After the transfer sheet is removed, toner transfer and image formation is successively carried out on the same image-receiving sheet 31 clinging to the rotating drum by successively using the remaining transfer sheets 33 having different colors (e.g., black, cyan, magenta and yellow) in the same manner to form a full color-image on the image-receiving sheet 31.

The image-receiving sheet 31 having a color image is taken out of the recording apparatus and forwarded to an image transfer zone (not shown), where the image side of the image-receiving sheet 31 is brought into contact with printing paper and pressed thereto under heat. Thus, the toner image is transferred onto the paper to produce printed paper.

Procedures for forming a full color image on the image-receiving sheet 31 by using four transfer sheets 33 of black, cyan, magenta and yellow, respectively, are described below more specifically by referring to FIG. 3.

In step 1, the image-receiving sheet 31 is wrapped to the rotating drum 15. In step 2, the black (K) transfer sheet 33 is wrapped on the image-receiving sheet 31. If necessary, the transfer sheet 33 is pressed onto the image-receiving sheet 33 under heat. In step 3, the transfer sheet is imagewise exposed according to previously stored image data. The image data has previously been processed by color separation, and exposure for each color of the transfer sheets is conducted based on the corresponding color image data. As a result, the toner of the transfer sheet 33 is imagewise transferred to the image-receiving sheet 31 to form a black toner image thereon.

In step 4, the transfer sheet K 33 is stripped off the rotating drum 15. In this stage the transferred image on the image-receiving sheet 31 is examined to see whether or not a desired color image has been formed. According to necessity, each of the other transfer sheets C, M and Y 33 is successively fed, and steps 2 through 4 are repeated. That is, step 5 (feed of the transfer sheet C), step 6 (laser scanning according to C data), step 7 (removal of the transfer sheet C), step 8 (feed of the transfer sheet M), step 9 (laser scanning according to M data), step 9 (removal of the transfer sheet M), step 10 (removal of the transfer sheet M, step 11 (feed of the transfer sheet Y), step 12 (laser scanning according to Y data), and step 13 (removal of the transfer sheet Y) are carried out to form a color image on the image-receiving sheet 31.

The image-receiving sheet 31 is stripped from the drum 15 and forwarded to an image transfer zone where the toner image of the image-receiving sheet 31 is transferred to printing paper to give printed paper in proof.

Since the package 21 contains the recording media 23 stacked in order of feed to the recording drum 15, the recording media 23 taken out of the package 21 can be set on the recording apparatus 11 all at once. There is no need to manually make a set of recording media each taken out of the respective packages. As a result, the recording media 23 are prevented against contamination with foreign matter, and image defects due to foreign matter can be reduced. Human errors of making a set of recording media in wrong order are excluded. The package 21 saves labor for preparing a set of recording media 23.

Stacked as a top sheet, the image-receiving sheet 31 is always the first to be fed into the recording apparatus 11 and fixed to the rotating drum 15. With the image-receiving sheet 31 once fixed on the drum 15, the transfer sheets 33 are then selectively fed and superposed thereon in succession.

Figure 4:
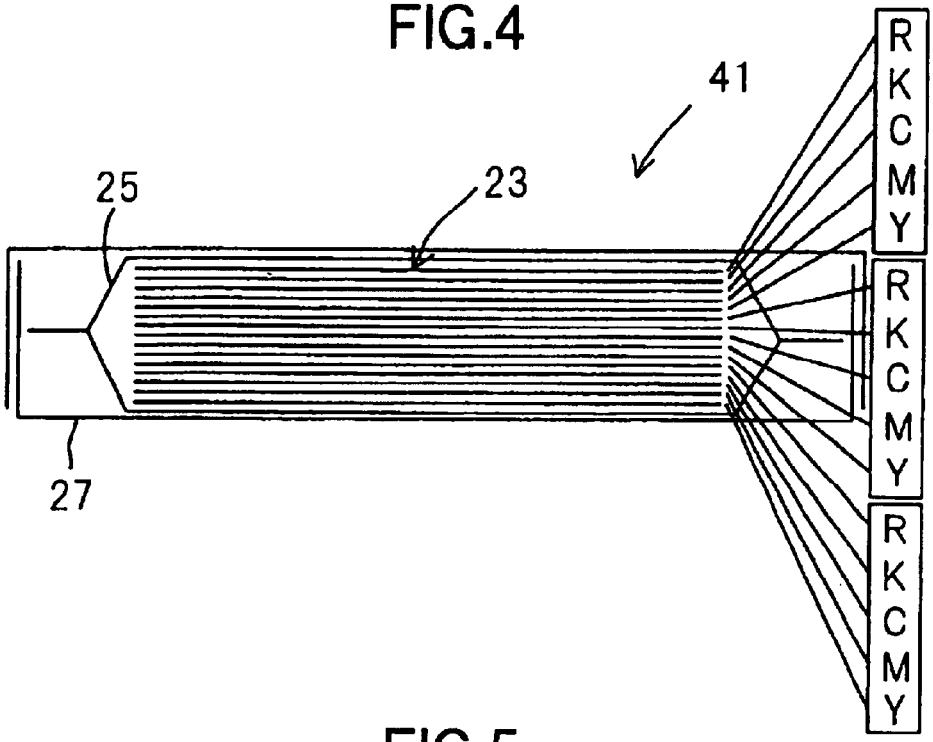
FIG. 4 is a schematic cross-section of a package according to a second embodiment of the invention.

A package according to a second embodiment of the invention is now described. A cross-sectional view of the package 41 of this embodiment is shown in FIG. 4. In what follows, the same members as used in FIGS. 1 to 3 are given the same numerals or symbols, and a repetition of description therefor is omitted.

The package 41 contains a plurality of sets of recording media (e.g., RKCMY). In the example shown in FIG. 4, there are three sets in the package 41. Similarly to the package 21, the sets are vacuum-packed in a packaging material 25 (e.g., polyethylene b ag), and the bag is put into a container 27, (e.g., a paperboard box) to complete the package 41. At least one and up to a desired number of the sets are taken out of the package 41 and is/are set in the cassette 9. Not all the sets in the package 41 do not need to be set in the cassette 9. For example, where the package 41 has 10 sets of recording media 23, 4 sets out of 10 may be taken out and placed in the cassette 9. Similarly to the package 21, the order of stacking the recording media, i.e., the order of recording includes RKYMC, RYMCK, RCMYK, and the like. It is essential for any order that R be the top sheet to be fed first.

The package 41 is convenient in disposing a plurality of sets of the recording media 23 in the recording apparatus 11 to carry out recording continuously. In this case, the image-receiving sheet of the uppermost (first) set of the recording media 23 is fixed on the drum 15, and a color image is successively recorded thereon by successively feeding the transfer sheets 33 of different colors. On completion of the recording and removal of the image-receiving sheet 31 of the first set, another image-receiving sheet 31 of another (second) set is fixed on the drum, followed by transfer recording with the transfer sheets of different colors of that set. After one cycle of recording has been finished, another cycle of recording can start in a continuous manner without intermittently disposing another set of recording media. That is, color image recording can be repeated in continuous manner as many times as the sets of recording media without involving manual work of preparing a set and inserting the set in the cassette one by one. Great labor saving can thus result.

Figure 5:
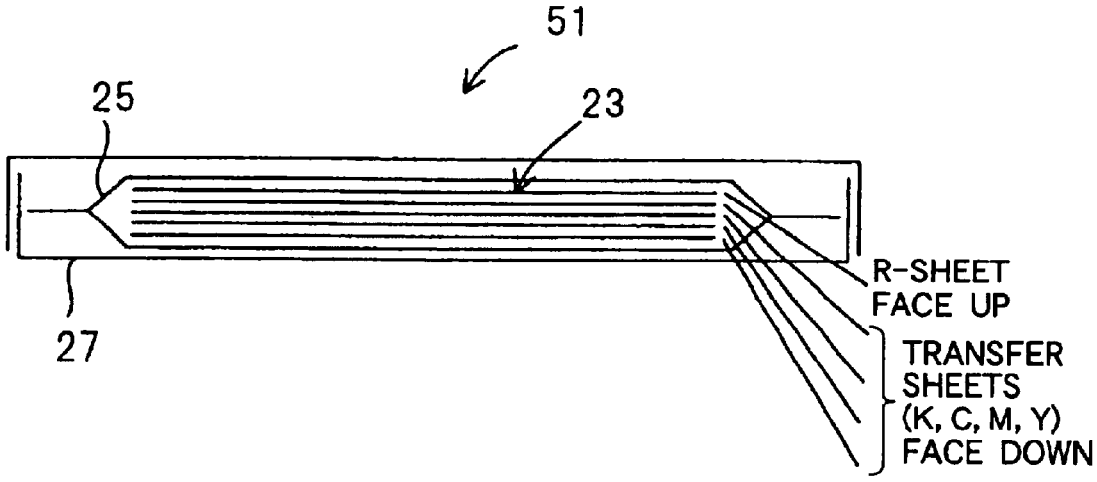
FIG. 5 is a schematic cross-section of a package according to a third embodiment of the invention in which the image-receiving layer faces up.
Figure 6:
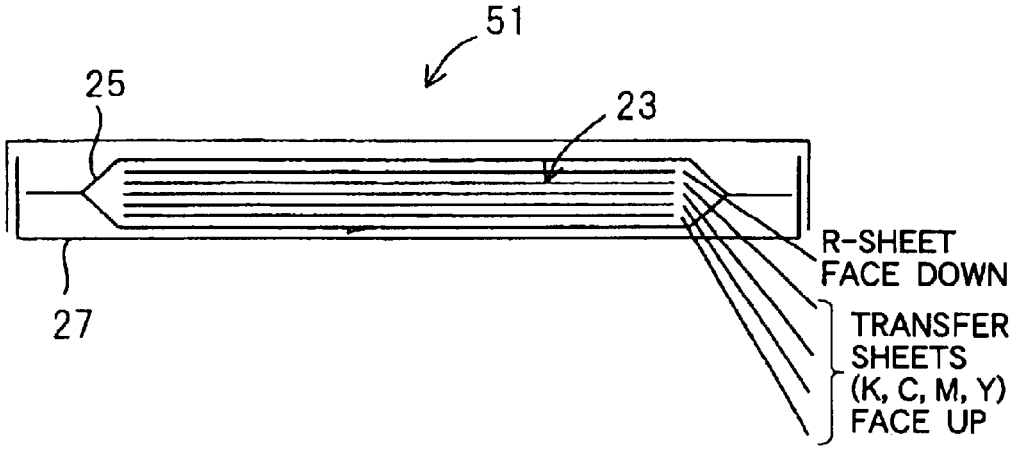
FIG. 6 is a schematic cross-section of a package according to third embodiment in which the image-receiving layer faces down.
Figure 7A:
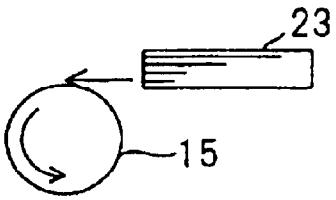
FIGS. 7A and 7B are each a side view showing the positional relationship between a set of recording media and a recording medium holding member.
Figure 7B:
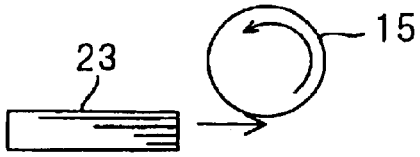

A package 51 according to a third embodiment of the invention is described by referring to FIGS. 5 through 7. FIG. 5 is a cross-sectional view of the package 51 in which the image-receiving sheet R is placed with its image-receiving layer side up, while FIG. 6 is a cross-sectional view of a package 51 in which the image-receiving R is placed with its image-receiving layer side down. FIGS. 7A and 7B each show a side view of a set of recording media taken out of the packages shown in FIG. 5 and FIG. 6, respectively, being fed to the rotating drum 15.

According to the third embodiment, the package 51 has a set of recording media 23 stacked in order to feed to the drum 15 in such a manner that the image-receiving layer 31*c* of the image-receiving sheet 31 and the toner layer 33*c* of each transfer sheet 33 face opposite. The package 51 can have two different modes of stacking as shown in FIGS. 5 and 6. The image-receiving layer 31*c* of the image-receiving sheet 31 faces up in FIG. 5 and down in FIG. 6.

In FIG. 5 where the image-receiving layer 31*c* faces up, the toner layers 33*c* of all the transfer sheets 33 face down. In this case, each recording medium is fed to the upper part of the drum 15 as shown in FIG. 7A so that the image-receiving sheet 31 (top sheet) may be fixed on the drum 15 with its image-receiving layer 31*c* outside, and each of the transfer sheets 33 may be superposed thereon to bring its toner layer 33*c* into contact with the image-receiving layer 31*c*.

In FIG. 6 where the image-receiving layer 31*c* faces down, the toner layers 33*c* of all the transfer sheets 33 face up. In this case, each recording medium is fed to the lower part of the drum 15 as shown in FIG. 7B so that the image-receiving sheet 31 (top sheet) may be fixed on the drum 15 with its image-receiving layer 31*c* outside, and each of the transfer sheets 33 may be superposed thereon to bring its toner layer 33*c* into contact with the image-receiving layer 31*c*.

Therefore, the package 51 makes it possible to superpose a transfer sheet 33 on the image-receiving sheet 31 to bring the image-receiving layer 31*c* and the toner layer 33*c* into contact without requiring an operation of turning over either the image-receiving sheet 31 or the transfer sheet 33 while being transported. This embodiment secures rapid feed of the recording media 23 in their travel from the cassette 9 to the recording drum 15. Where the package 51 has a plurality of sets of the recording media 23, every image-receiving sheets 31 in one package faces in one direction, and every transfer sheet 33 faces in another direction.

Figure 8:
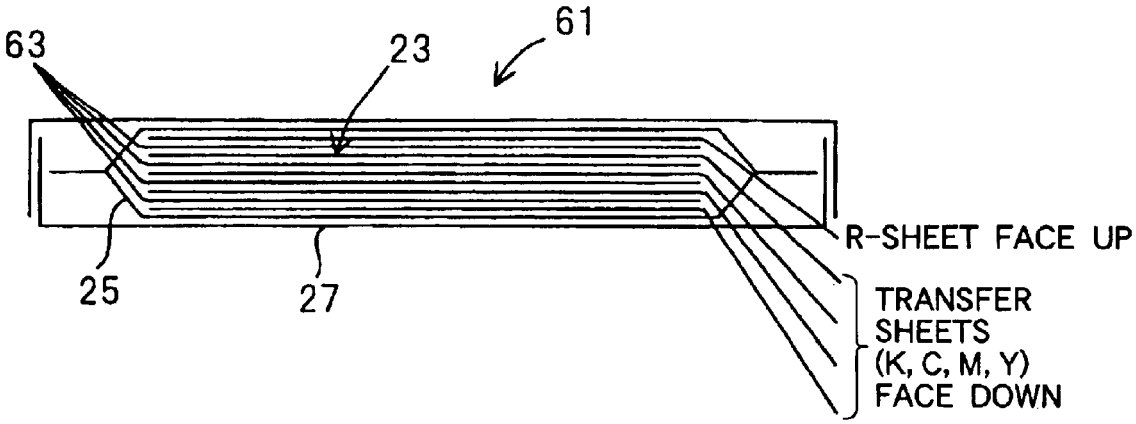
FIG. 8 is a schematic cross-section of a package according to a fourth embodiment of the invention.

A package 61 according to a fourth embodiment of the invention is described by referring to FIG. 8. The package 61 shown in FIG. 8 has an interleaving sheet 63 between every two adjacent recording media 23 stacked in order of feed to the rotating drum 15. The interleaving sheet 63 can be made of paper. It is preferred for the interleaving sheet 63 to have a surface roughness Ra of 1 to 50 $\mu$m and a thickness of about 10 to 300 $\mu$m. Similarly to the package 21, a set of the recording media 23 having the interleaving sheets 63 and the recording media 23 alternating is vacuum-packed in a packaging material 25 (e.g., a polyethylene bag), and the bag is put into a container 27 (e.g., a paperboard box) to complete the package 61.

According to the fourth embodiment, the inserted interleaving sheet 63 serves as a slip sheet to improve the slip of the recording media 23. That is, each recording medium 23 can slide out easily with improved release from the underlying sheet so that feed troubles, such as double sheet feeding or a failure of feeding due to blocking of sheets, can be reduced. Besides, the interleaving sheets 63 are effective in protecting the recording media 23 against scratches.

Figure 9:
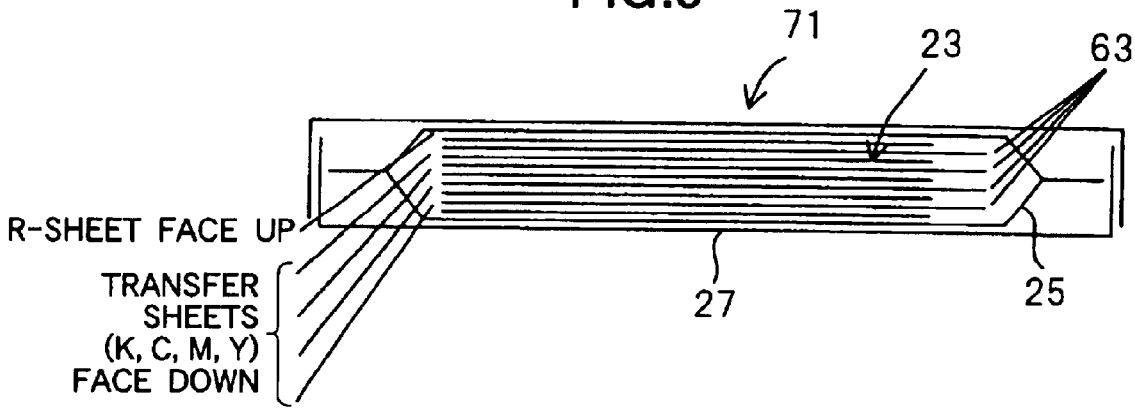
FIG. 9 is a schematic cross-section of a package according to a fifth embodiment of the invention.
Figure 10:
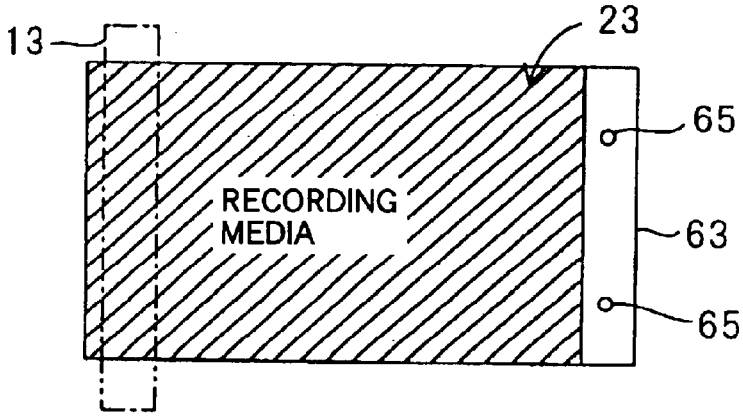
FIG. 10 is a plan view of a set of recording media and the extension of an interleaving sheet having perforations for fixing, which can be used in the fifth embodiment.

A package 71 according to a fifth embodiment of the invention is described by referring to FIGS. 9 and 10. FIG. 9 is a schematic cross-section of the package 71, and FIG. 10 is a plan view of a set of recording media and an extended part of interleaving sheets 63 having perforations 65 for fixing. The package 71 shown in FIG. 9 has an interleaving sheet 63 inserted between every adjacent sheets of a set of recording media 23 stacked in order of feed to the rotating drum 15 (e.g., in order of RKCMY), each interleaving sheet 63 extending from at least one edge of the recording media 23 in a set. Similarly to the package 21, the set of the recording media 23 having the extending interleaving sheets 63 is vacuum-packed in a packaging material 25 (e.g., a polyethylene bag), and the bag is put into a container 27 (e.g., a paperboard box) to complete the package 71.

According to this embodiment, the interleaving sheets 63 can be fixed at their extended part (extension) to either the recording apparatus 11 or the cassette 9. Being fixed, the interleaving sheets 23 can be prevented from coming out when the recording media 23 are fed. The interleaving sheet 23 does not need to extend over the whole length of the side of the set. An extension from part of the side length enough to be fixed would suffice for the intended purpose.

As shown in FIG. 10, the interleaving sheets 23 preferably extend from the side of the set of recording media 23 which is opposite to the side to be brought into contact with the pickup mechanism 13 of the recording apparatus 11. In this case, the extension can easily be fixed to the recording apparatus 11 or the cassette 9 by, for example, clipping. In this way, the interleaving sheets 63 are prevented from being drawn out together with a recording medium by the force of the pickup mechanism 13.

The interleaving sheet 63 preferably has at least one perforation 65 in its extension and is fixed to a recording apparatus by making use of the perforation. In this case, the interleaving sheets 63 can be easily and securely fixed to the recording apparatus (or the cassette) by a fixing means (not shown) provided on the recording apparatus (or the cassette).

Figure 11:
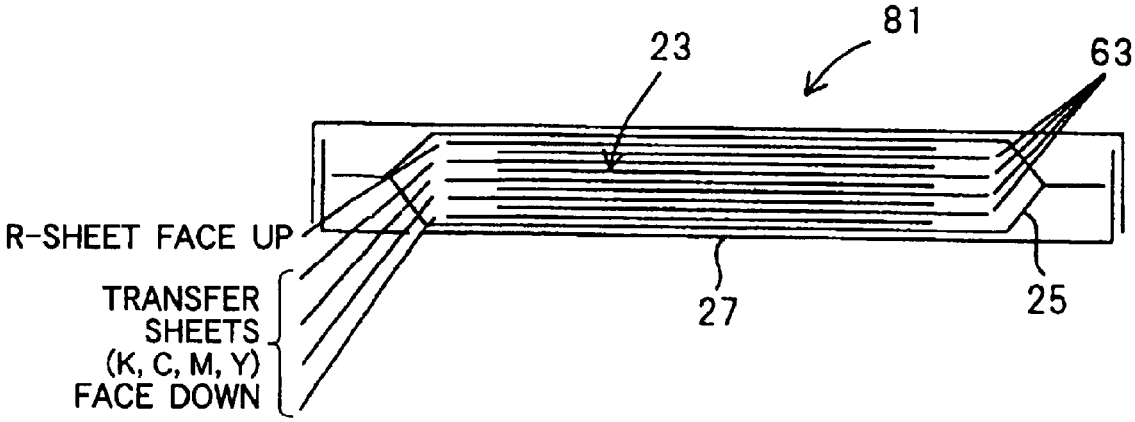
FIG. 11 is a schematic cross-section of a package according to a sixth embodiment of the invention.
Figure 12:
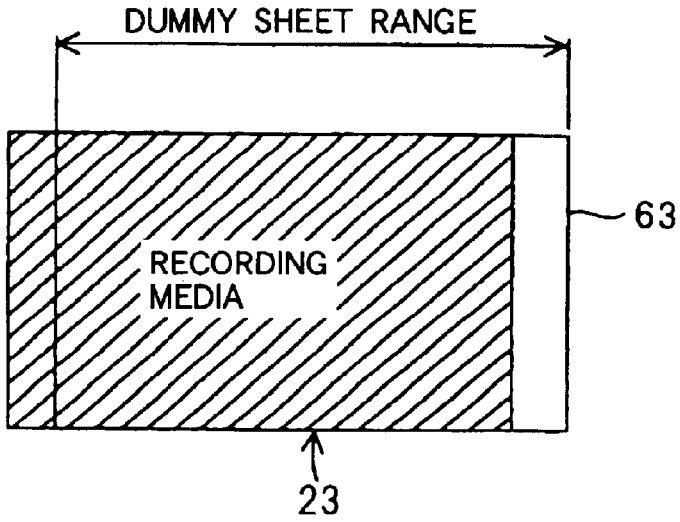
FIG. 12 is a plan view of the set of recording media in the package shown in FIG. 11.
Figure 13:
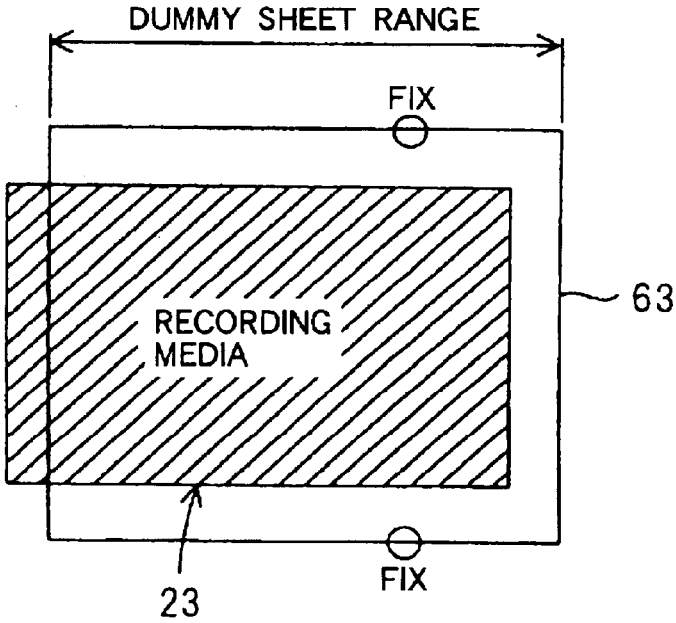
FIG. 13 is a plan view of a set of recording media in which interleaving sheets extend outward from three sides of the set.

A package 81 according to a sixth embodiment of the invention is described by referring to FIGS. 11 to 13. FIG. 11 is a schematic cross-section of the package 81. FIG. 12 is a plan view of the set of recording media 23 of the package 81. FIG. 13 is a plan view of a set of recording media 23 in which interleaving sheets 63 extend from three sides of the set.

The package 81 contains recording media 23 stacked in order of feed to the rotating drum 15 (e.g., in order of RKCMY) with an interleaving sheet 63 inserted in every adjacent recording media, each recording medium sticking out from the edge of an interleaving sheet 63 in the side to be brought into contact with the pickup mechanism 13. Similarly to the package 21, the set of the recording media 23 in which the recording media 23 stick out from one side of the interleaving sheets 63 is vacuum-packed in a packaging material 25 (e.g., a polyethylene bag), and the bag is put into a container 27 (e.g., a paperboard box) to complete the package 81.

According to the sixth embodiment, when the pickup mechanism 13 of the recording apparatus 11 comes into contact with the end of the uppermost recording medium to drag out the recording medium, there is no interleaving sheet 63 right under the pressing member of the pickup mechanism 13 (see FIG. 10). Therefore, the rotational force and the pressing force of the pickup mechanism 13 are exerted only to the uppermost recording medium. As a result, the interleaving sheet 63 underneath the recording medium is securely prevented from being dragged together with that recording medium.

Where the recording media 23 and the interleaving sheets 63 used in the package 81 have the same size, it naturally follows that the interleaving sheets 63 stick out from the side opposite to the side where the recording media 23 stick out as shown in FIG. 12. The side from which the interleaving sheets 63 extend or stick out is not limited to the side opposite to the pickup mechanism 13 side. For example, the interleaving sheets 63 may extend from both side edges (the sides parallel to the moving direction of the recording media 23) as shown in FIG. 13. In this case, the interleaving sheets 63 may be fixed to the recording apparatus (or the cassette) at the parts extending from the side edges.

Figure 14:
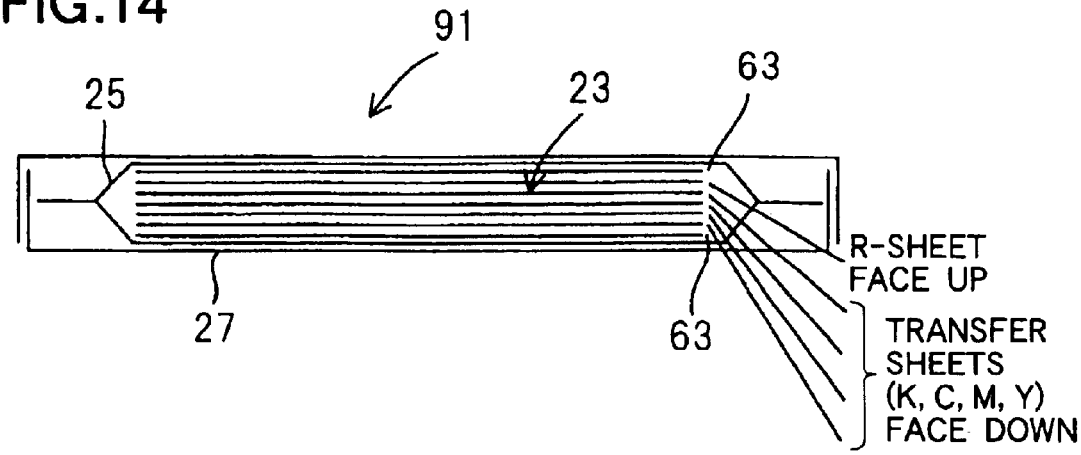
FIG. 14 is a schematic cross-section of a package according to a seventh embodiment of the invention.

A package 91 according to a seventh embodiment of the invention is shown in FIG. 14. The package 91 has a set of recording media 23 stacked in order of feed to the rotating drum 15 (e.g., in order of RKCMY) and packed in the packaging material 25 (e.g., a polyethylene bag) and also contains an interleaving sheet 63 between the image-receiving layer 31*c* of the uppermost image-receiving sheet 31 and the packaging material 25 and between the toner layer 33*c* of the lowermost transfer sheet 33 and the packaging material 25. The package containing the set of the recording media 23 with the interleaving sheet 63 at both the top and the bottom thereof is put into a container 27 (e.g., a paperboard box) to complete the package 91 similarly to the package 21.

According to this embodiment, the image-receiving layer 31*c* of the uppermost recording medium (image-receiving sheet 31) and the toner layer 33*c* of the undermost transfer sheet 33 are prevented from direct contact with the packaging material 25. As a result, the image-receiving layer 31*c* and the toner layer 33*c* are protected from undergoing changes in physical or performance properties due to contact with the packaging material, e.g., a synthetic resin bag. In addition, any pattern of the synthetic resin bag as a packaging material 25 is prevented from being transferred to the recording media 23.

The interleaving sheets 63 used in the package 91 are preferably made of the same material as used to make the substrate of the recording media 23 (i.e., the substrate 31*a* or 33*a*). For example, a recording medium having no image-receiving layer 31*c* nor toner layer 33*c*, i.e., the substrate 31*a* or 33*a* can be used as the interleaving sheet 63. Since the recording media and the material with which the recording media are brought into contact are of the same quality, adverse influences of the packaging material can further be lessened.

It is also preferred that at least the side of the interleaving sheet 63 that is in contact with the recording medium has the same properties and conditions as the side of the recording medium opposite to its image-receiving layer or toner layer side. For example, that side of the interleaving sheet 63 and that side of the recording medium can have the same antistatic coating and approximately the same surface roughness. The antistatic coating secures easy slip, and the similar surface roughness secures the same level of slipperiness.

Figure 15A:
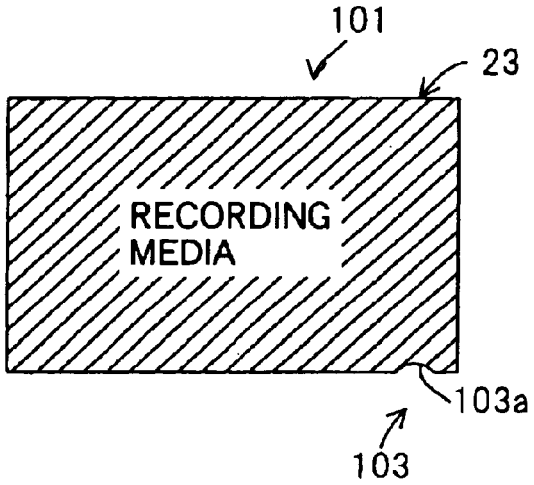
FIGS. 15A and 15B are each a plan of a set of recording media in a package according to an eighth embodiment of the invention.
Figure 15B:
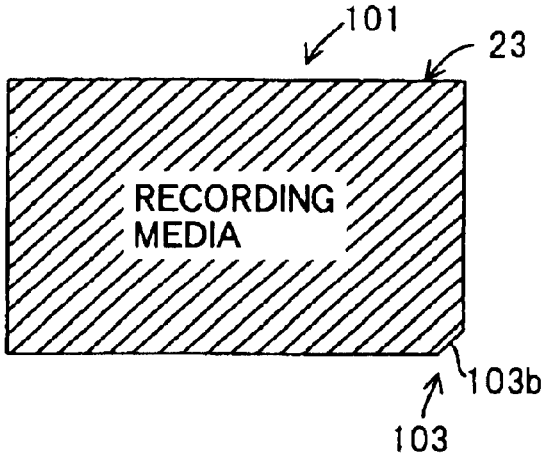
Figure 16:
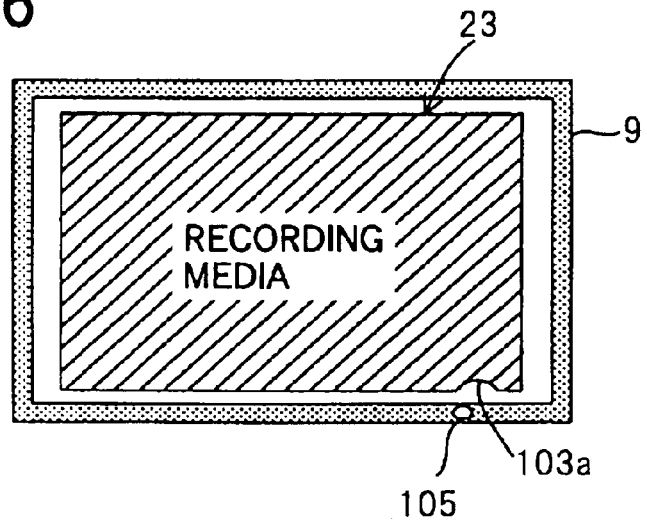
FIG. 16 is a plan of a cassette having a means for regulating directionality in which the set of recording media shown in FIG. 15A is put.
Figure 17:
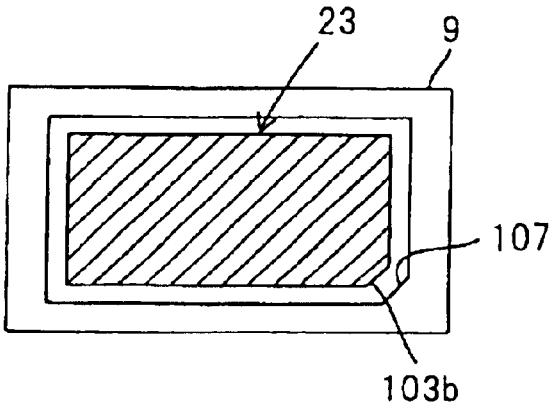
FIG. 17 is a plan of a cassette having a means for regulating directionality in which the set of recording media shown in FIG. 15B is put.
Figure 18:
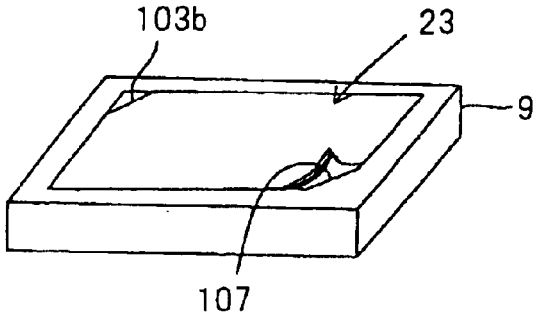
FIG. 18 is a perspective of the cassette shown in FIG. 17 in which the set of FIG. 15B is placed in a wrong direction.

A package 101 according to an eighth embodiment of the present invention is described by referring to FIGS. 15 through 18. FIGS. 15A and 15B each show a plan view of a set of recording media 23 in the package 101. FIG. 16 is a plan view of the set shown in FIG. 15A as put into a cassette. FIG. 17 is a plan view of a cassette having a means for regulating directionality in which the set shown in FIG. 15B is put. FIG. 18 is a perspective view of the cassette shown in FIG. 17 in which the set shown in FIG. 15B is set in a wrong direction.

The package 101 according to the eighth embodiment contains recording media 23 stacked in order of feed to the rotating drum 15 (e.g., in order of RKCMY), in which the uppermost recording medium 23 or the interleaving sheet 63 placed thereon has a mark 103 indicating directionality. According to this embodiment, whether or not the set of the recording media 23 is set in a cassette with its right side up or in a right direction can easily be seen by checking the mark 103 against a mark made on the recording apparatus or the cassette body. These marks checking out with each other indicate that the recording media 23 are set in a right direction with their right side up, i.e., in a correct order of feed to the rotating drum 15.

The mark 103 can be a notch 103*a* made on a side of the recording medium 23 as shown in FIG. 15A or a notch 103*b* made on a corner of the recording medium 23 as shown in FIG. 15B. The mark 103 may be a fold, a projection, a hole, a color mark, etc. in place of the notch.

Where the mark 103 is the notch 103*a* shown in FIG. 15A, the cassette 9 in which a set of the recording media 23 is to be placed has a mark 105 as shown in FIG. 16. The marks 103*a* and 105 checking out with each other indicate that the recording media 23 are set in a right direction with their right side up, i.e., in a correct order of feed to the rotating drum 15.

Where the mark 103 is the notch 103*b* shown in FIG. 15B, the cassette 9 in which a set of the recording media 23 is to be placed has a directionality regulating means 107 as shown in FIG. 17. The directionality regulating means 107 is a fillet provided at the corner corresponding to the mark 103 in conformity to the mark 103. Should the set of the recording media 23 be placed upside down or in a wrong direction, it does not fit into the cassette 9 because the notch 103*b* and the directionality regulating means 107 are not mated as shown in FIG. 18. Thus, whether the set of the recording media 23 is correctly set in the cassette can be checked up not only visually but physically.

Figure 19:
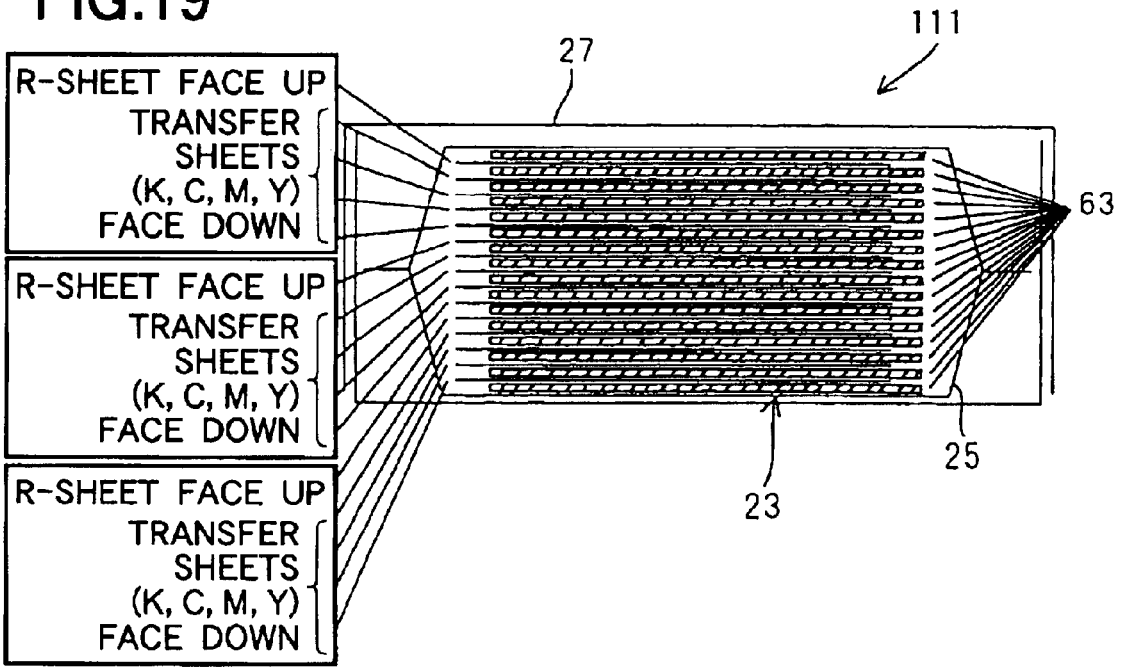
FIG. 19 is a schematic cross-section of a package of recording media which satisfies all the requirements of the preferred embodiments of the present invention.

A package 111 shown in FIG. 19 is an embodiment embracing all the advantages presented by the above-described first to eighth embodiments of the present invention. Specifically, the package 111 contains a plurality of sets of recording media 23, the recording media 23 in each set being stacked in order to feed to the rotating drum 15. The image-receiving layer 31*c* of every image-receiving sheet 31 and the toner layer 33*c* of every transfer sheet 33 face in opposite directions. An interleaving sheet 63 is inserted between every adjacent recording media 23. The interleaving sheets 63 extend outward from at least one side of the recording media 23 and have at least one perforation 65 for fixing in the extension thereof. Each recording medium 23 sticks out from the opposite side where the pickup mechanism 13 is applied. The interleaving sheet 63 is also inserted between the packaging material 25 and the top and the bottom of the recording media 23. At least the side of the interleaving sheet 63 which is in contact with the recording media 23 has the same properties or conditions as the side of the recording medium 23 opposite to the image-receiving layer 31*c* side or the toner layer 33*c* side. The interleaving sheet 63 which is put on the image-receiving sheet 31 as a top sheet has a mark 103 indicating directionality, such as the notch 103*a* or the 103*b*. The package 111 is thus designed to exhibit all the effects obtained by the above-described preferred embodiments of the invention.

Since the package of the invention has recording media stacked in order of feed to a recording medium holding member of a recording apparatus, a desired number of sets of the recording media can be put on a recording apparatus at a time with no need to manually set recording media one by one on a recording apparatus. As a result, the possibility of each recording medium's being contaminated with foreign matter is reduced to reduce resultant image defects. Further, a recording failure due to a wrong stacking order of recording media never occurs. The package also brings about saving of labor for preparing a set of recording media.

Figure 20:
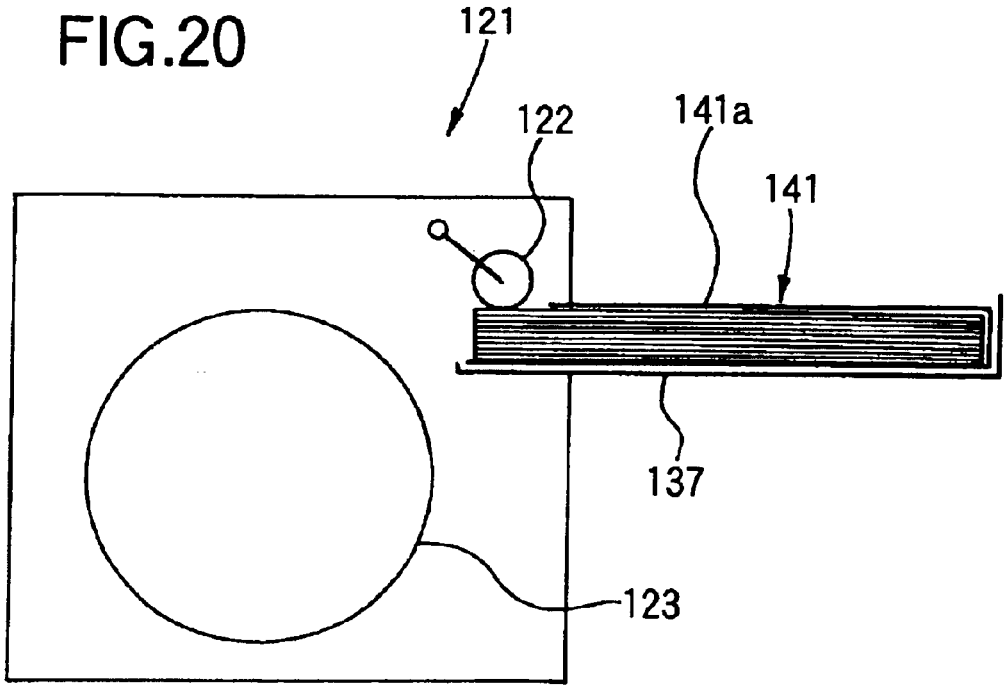
FIG. 20 schematically illustrates the constitution of the recording apparatus according to the present invention.
Figure 21:
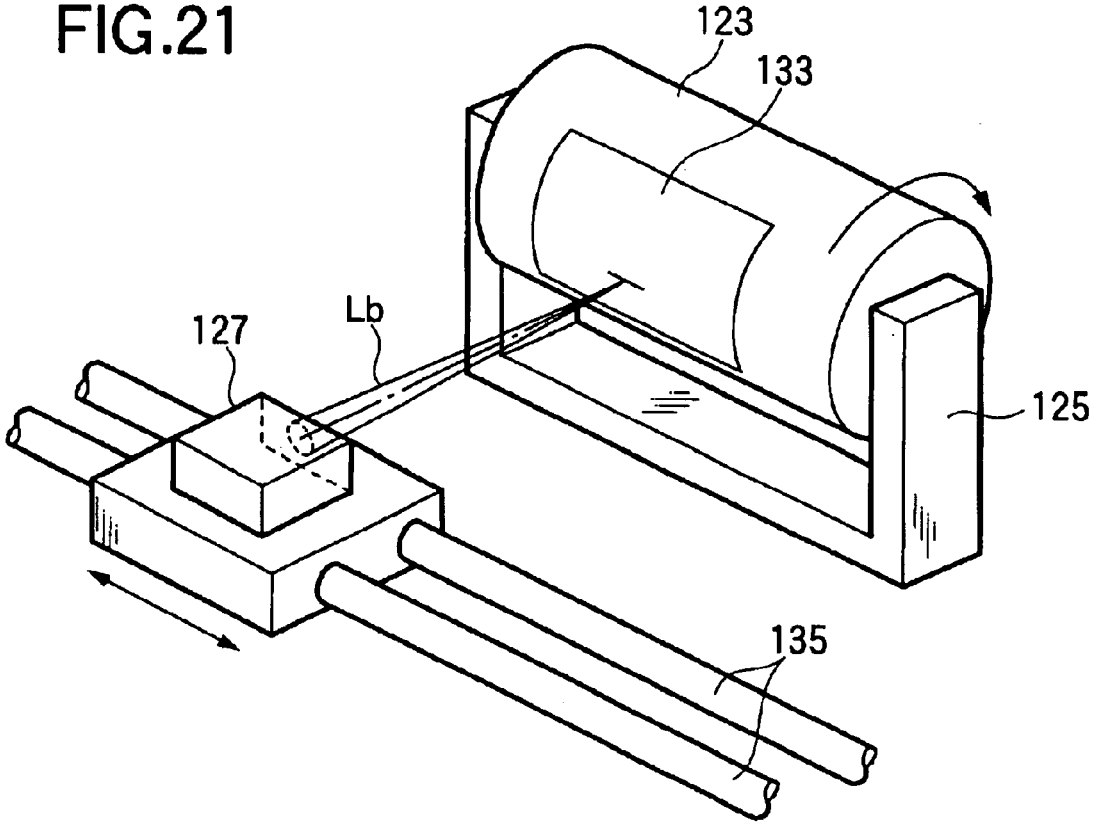
FIG. 21 is a perspective of a recording medium holding member and a recording head of a recording apparatus.

The present invention will be described in detail with reference to its preferred embodiments by referring to the accompanying drawings. FIG. 20 schematically illustrates the constitution of the recording apparatus according to the present invention. FIG. 21 is a perspective of a recording medium holding member and a recording head of the recording apparatus. FIG. 2 is a schematic cross-section of recording media being combined for recording.

Recording apparatus include a rotary system in which recording media are wound around a rotating drum, and, while the drum is rotated, the recording media are scanned in the drum axial direction with a moving recording head or a moving laser beam spot from a recording head; and a self-traveling system in which recording media are transported on transport rollers, etc. to a recording position where they are scanned, while being transported, in the direction perpendicular to the transport direction with a moving recording head or a moving laser beam spot from a recording head. A rotating drum used in the rotary system and nip rolls used in the self-traveling system correspond to the recording medium holding member. The present invention will be described with particular reference to the rotary system for instance.

As shown in FIGS. 20 and 21, the recording apparatus 121 has a rotating drum 123 as a recording medium holding member in its recording zone. The rotating drum 123 is a hollow cylinder and rotatably held on a frame 125. The direction of drum rotation is the main scanning direction. The rotating drum 123 is connected to a rotating shaft of a motor (not shown) and driven by the motor.

The recording apparatus 121 also has a recording head 127 in the recording zone. The recording head 127 emits a laser beam Lb. The irradiated area of the toner layer of a transfer sheet 133 is transferred to the surface of an image-receiving sheet 131 which underlies the transfer sheet 133. The head 127 slides linearly along guide rails 135 in the direction parallel with the rotating axis of the drum 123. The moving direction of the recording head 127 is a secondary scanning direction. The drum's rotary motion and head's linear motion are combined appropriately to make a scan of the transfer sheet 133 thereby to transfer a desired image onto the image-receiving sheet 131.

As shown in FIG. 22, the recording apparatus 121 has a cassette holder 137. The cassette holder 137 is designed such that a cassette 141 containing at least one set of recording media consisting of the image-receiving sheet 131 and a plurality of transfer sheets 133 can be directly attached thereto and detached therefrom. In carrying out recording, the cassette 141 is mounted on the cassette holder 37, and the recording media is fed one by one to the rotating drum 123.

Figure 22A:
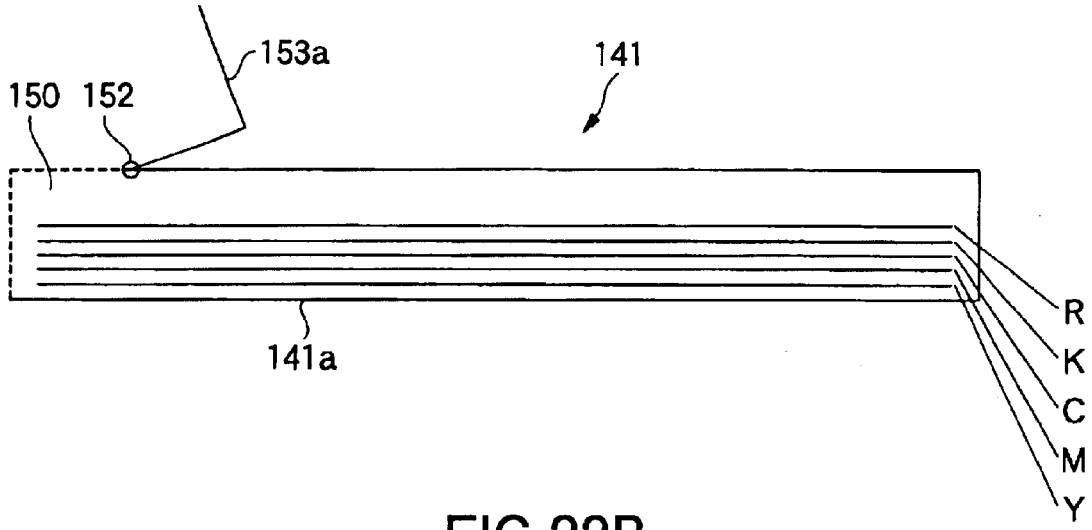
FIGS. 22A–22C are schematic cross-sections of a preset cassettes according to the present invention.
Figure 22B:
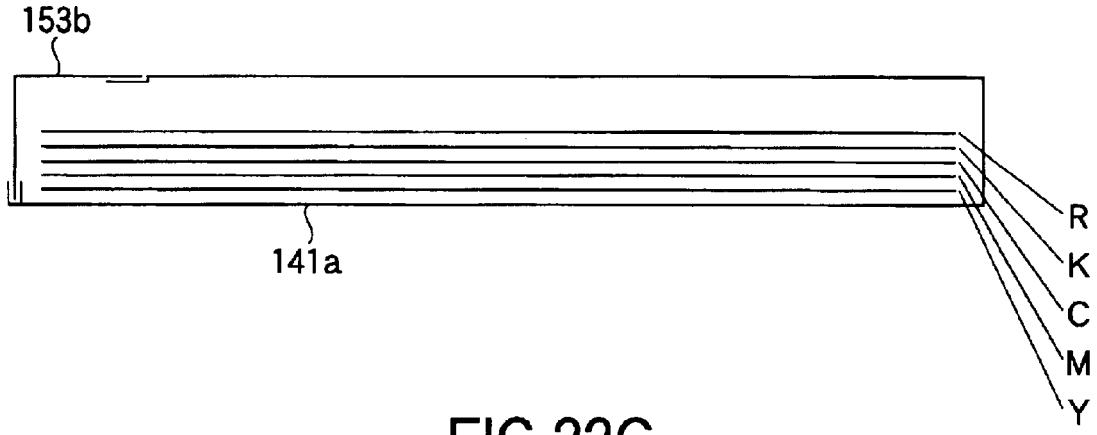
Figure 22C:
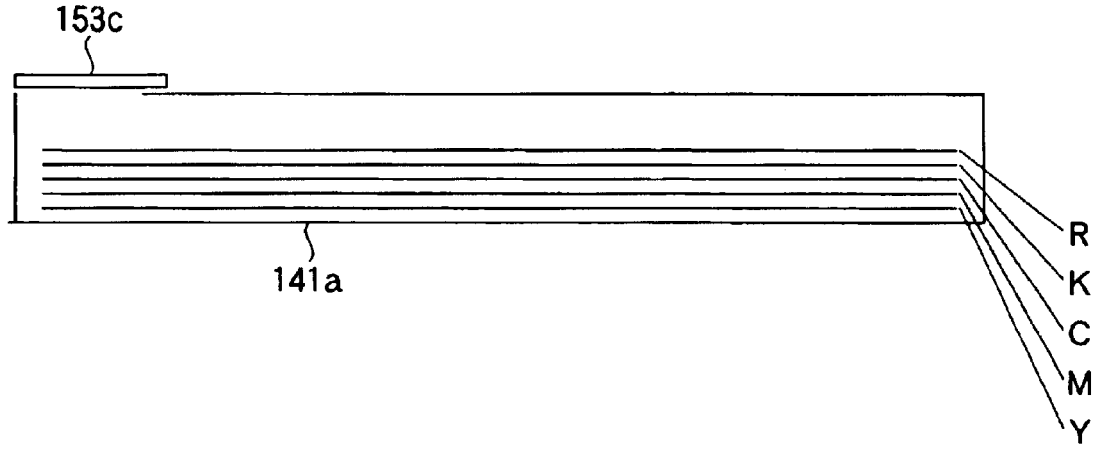

FIGS. 22A–22C show the examples of the recording medium feed cassette according to the invention. The cassette 141 shown contains a set of recording media consisting of an image-receiving sheet 131 and transfer sheets 133 in order of feed to the rotating drum 123. In these embodiments, the set of recording media consists of, from the top, an image-receiving sheet R, a transfer sheet K, a transfer sheet C, a transfer sheet M, and a transfer sheet Y. The uppermost recording medium is picked up by a pickup mechanism 122 (see FIG. 20) of the recording apparatus 121 and fed to the recording zone of the recording apparatus 121. While every adjacent recording media are in contact with each other, they are depicted with a gap therebetween in FIG. 22A and other similar drawings for the sake of distinction.

Since the recording apparatus 121 has the cassette holder 37, there is no need to secure a space inside the apparatus 121 for placing the recording medium feed cassette 41, which favors size reduction of a recording apparatus.

The cassette body 141*a* of the recording medium feed cassette 141 is preferably made of metal. In this case, static electricity, if generated by friction among the stacked recording media during transportation, is not accumulated because it is allowed to escape to the cassette body 141*a*. As a result, the recording media are prevented from clinging to each other due to electrostatic force and thereby from being fed together.

It is also preferred that the cassette body 141*a* be made of paperboard, which is cheap and easy to fabricate to reduce the material cost and the production cost. Paperboard-made cassette bodies, being recyclable, favor to effective utilization of resources and are environmentally friendly.

Even where the cassette 141 is made of a low-strength material, it is stably and securely fixed to the recording apparatus 121 by mounting on the rigid cassette holder 137. Therefore, even a cassette 141 having relatively low strength made of paperboard or plastics can be used as well.

In FIG. 22A, the cassette body 141*a* has an opening 150 for taking out the recording media. The opening 150 is covered with a lid 153*a* such that the opening is closed and opened by a hinge 152. Further, the lid 153*a* may be substituted by a lid 153*b* that is detachable from the cassette body 141*a* or a lid 153*c* that slides to open or close the opening 150. The lid 153*b*, which is an obstacle in fitting the cassette 141 to the recording apparatus 21, can be removed before fitting, which is advantageous for easy cassette fitting, and the cassette 141 has a simple structure. In case of adopting the lid 153*c*, the cassette 141 automatically opens upon fitting to the recording apparatus 121. Further, as opening the lid 153 of the cassette body 141*a*, the cassette body 141*a* changes from its closed state to a ready-to-feed state very quickly so that probability of dust entering through the opening 150 is reduced.

Figure 23:
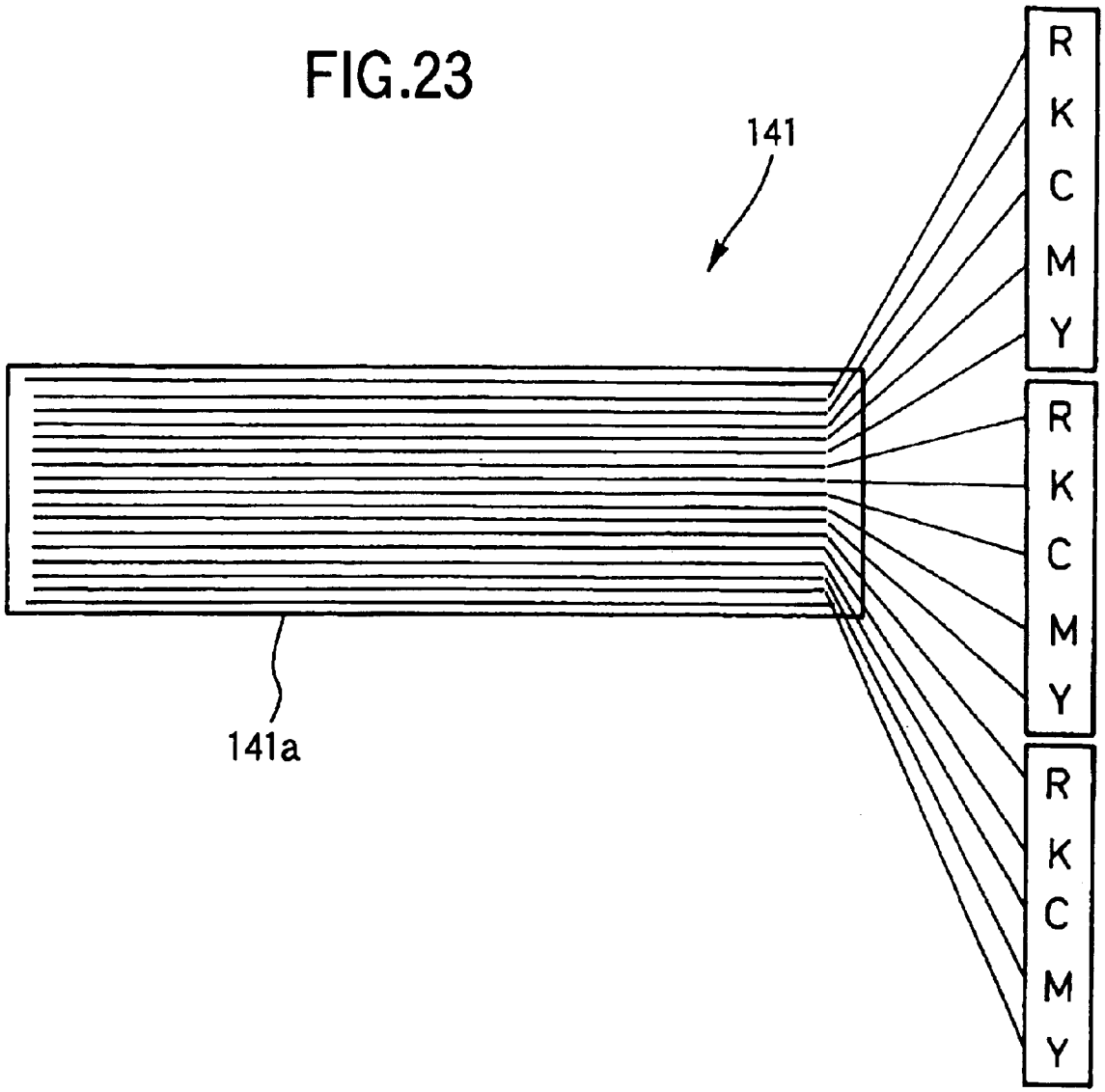
FIG. 23 is a schematic cross-section of a cassette of the invention which contains a plurality of sets of recording media.

The preset cassette 141 can contain a plurality of sets of recording media (e.g., RKCMY) as shown in FIG. 23. In the particular example shown in FIG. 23, there are three sets in the cassette 141. The order of stacking the recording media, i.e., the order of recording includes RKYMC, RYMCK, RCMYK, and the like. It is essential for any order that R be the top sheet to be fed first.

The recording media are stacked to make a set in such a manner that the image-receiving layer 131*c* of the image-receiving sheet 131 and the toner layer 133*c* of each transfer sheet 133 face opposite. The set can have two different modes of stacking as shown in FIGS. 6 and 7. That is, the image-receiving layer 131*c* of the image-receiving sheet 131 (R) faces up in FIG. 24 and down in FIG. 25.

Figure 24:
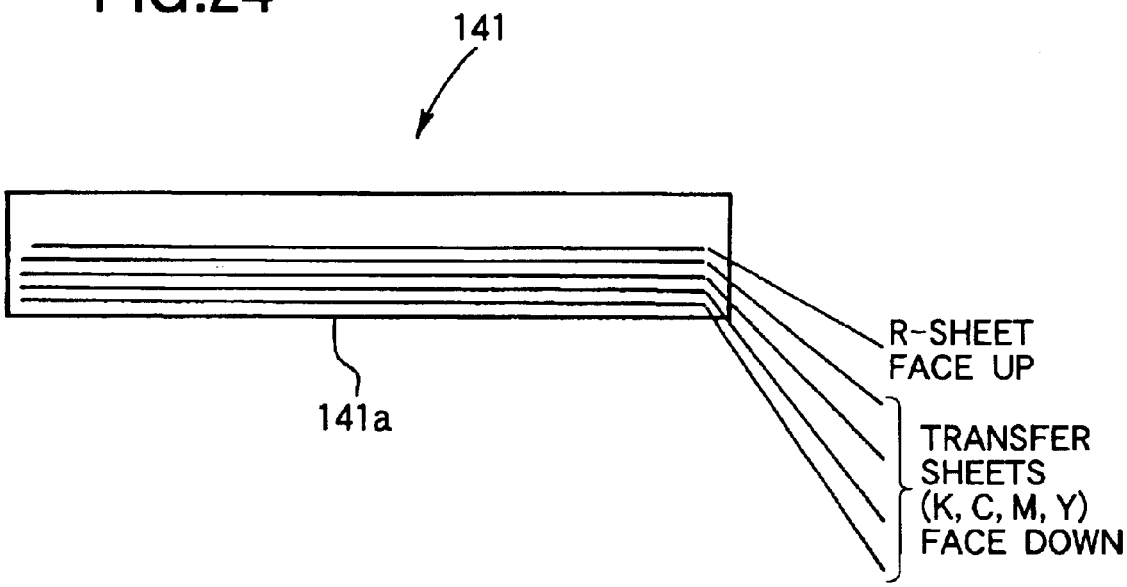
FIG. 24 is a schematic cross-section of a cassette of the invention in which the image-receiving layer (R) faces up, and the transfer sheets (K, C, M, and Y) face down.
Figure 26A:
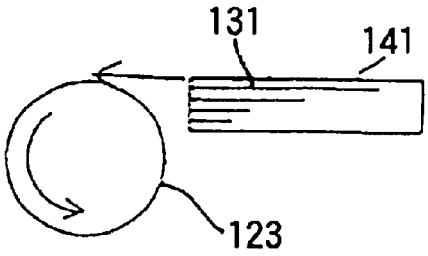

In FIG. 24 where the image-receiving layer 131*c* faces up, the toner layers 133*c* of all the transfer sheets 133 (K, C, M and Y) face down. In this case, each recording medium is fed to the upper part of the rotating drum 123 as shown in FIG. 26A so that the image-receiving sheet 131 (top sheet) may be fixed on the drum 123 with its image-receiving layer 131*c* outside, and each of the transfer sheets 133 may be superposed thereon to bring its toner layer 133*c* into contact with the image-receiving layer 131*c*.

Figure 25:
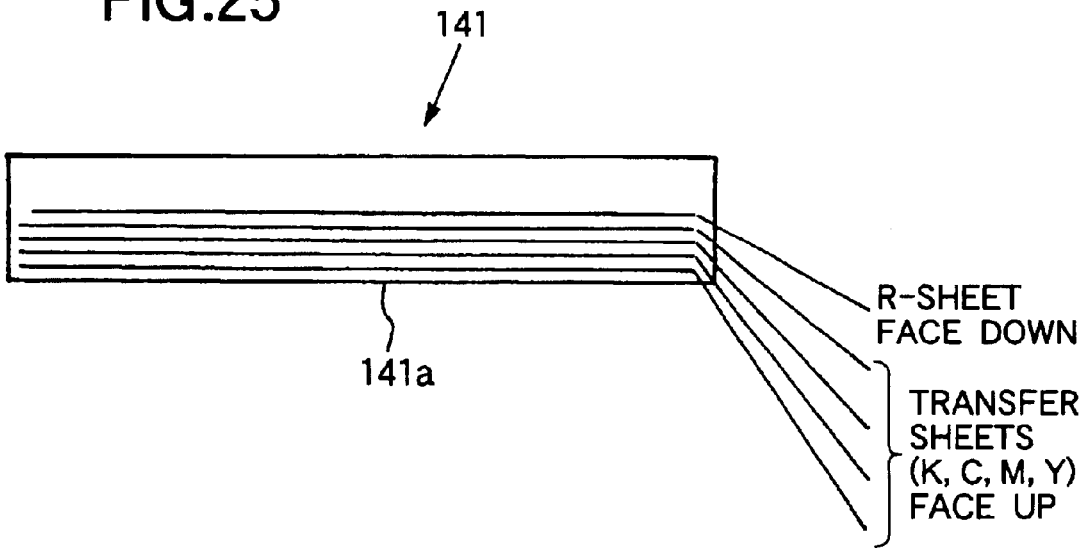
FIG. 25 is a schematic cross-section of a cassette of the invention in which the image-receiving layer faces down.
Figure 26B:
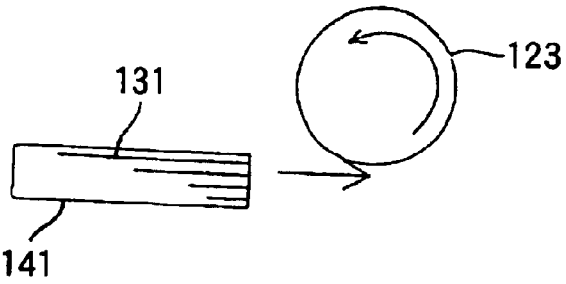

In FIG. 25 where the image-receiving layer 131*c* (R) faces down, the toner layers 133*c* of all the transfer sheets 133 (K, C, M and Y) face up. In this case, each recording medium is fed to the lower part of the drum 123 as shown in FIG. 26B so that the image-receiving sheet 131 (top sheet) may be fixed on the drum 123 with its image-receiving layer 131*c* outside, and each of the transfer sheets 133 may be superposed thereon to bring its toner layer 133*c* into contact with the image-receiving layer 131*c*.

Procedures for forming a full color image on the image-receiving sheet 131 by using four transfer sheets 133 of black (K), cyan (C), magenta (M) and yellow (Y), respectively, are described below more specifically by referring to FIG. 9.

First of all, the cassette 141 (51, 61, 71, 181 or 91) is fitted in the recording apparatus 121 as shown in FIG. 1, and the pickup mechanism 122 is started.

In step 1, the image-receiving sheet 31, the top sheet, is fed to the rotating drum 123. In step 2, the black (K) transfer sheet 133 is fed on the image-receiving sheet 131. If necessary, the transfer sheet 133 is pressed onto the image-receiving sheet 133 under heat.

The recording apparatus 121 according to the present invention has the following advantages. Since the cassette contains the recording media stacked in order of feed to the rotating recording drum 23, the recording apparatus 121 can be loaded with the necessary recording media all at once as a set simply by opening a package of the cassette 141 and fitting the cassette body 141*a* to the recording apparatus 121. There is no need to manually prepare a set of recording media each taken out of the respective packages. As a result, the recording media are prevented against contamination with foreign matter, and image defects due to foreign matter can be reduced. Human errors of making a set of recording media in wrong order are excluded. Since a plurality of sets of recording media can be set at once, the labor can be saved.

Stacked as a top sheet, the image-receiving sheet 131 is always the first to be fed into the recording apparatus 121 and fixed to the rotating drum 123.

With the image-receiving sheet 131 once fixed on the drum 23, the transfer sheets 133 are then selectively fed and superposed thereon in succession.

Where the cassette contains a plurality of sets of recording media, a plurality of sets can be set at a time. In this case, the image-receiving sheet of the uppermost (first) set of the recording media is fixed on the drum 23, and a color image is successively recorded thereon by successively feeding the transfer sheets 133 of different colors. On completion of the recording and removal of the image-receiving sheet 131 of the first set, another image-receiving sheet 131 of another (second) set is fixed on the drum 23, followed by transfer recording with the transfer sheets of different colors of that set. After one cycle of recording has been finished, another cycle of recording can start in a continuous manner without intermittently disposing another set of recording media. That is, color image recording can be repeated in continuous manner as many times as the sets of recording media without involving manual work of making a set and inserting the set in the cassette one by one. Great labor saving can thus result.

Since the image-receiving layer 131*c* of the image-receiving sheet 131 and the toner layers 133*c* of the transfer sheets 133 face opposite in each set, the image-receiving layer 131*c* and the toner layer 133*c* can be brought into contact without requiring an operation of turning over either the image-receiving sheet 131 or the transfer sheet 133 while being transported. Accordingly, the recording media are rapidly transported from the cassette to the recording drum. Where the cassette has a plurality of sets of the recording media, every image-receiving sheets 131 in one cassette faces in one direction, and every transfer sheet 133 faces in another direction.

The recording apparatus 121 allows the preset cassette 141 to be fitted directly. It is no more necessary to make a set of recording media in a conventional cassette. Adhesion of foreign matter to the recording media is reduced. There is no possibility of making a wrong set of recording media. The labor for making a set of recording media is greatly saved.

Figure 27:
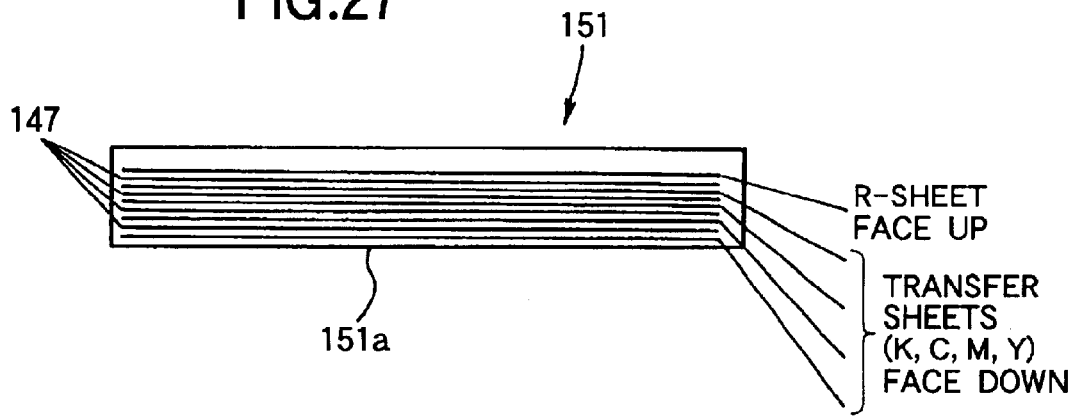
FIG. 27 is a schematic cross-section of a cassette according to a second embodiment of the invention.

A preset cassette 151 according to a second embodiment of the invention is described by referring to FIG. 27. The cassette 151 shown in FIG. 27 has an interleaving sheet 147 inserted between every two adjacent recording media stacked in the cassette body 151*a*. The interleaving sheet 147 can be made of paper. It is preferred for the interleaving sheet 147 to have a surface roughness Ra of 1 to 150 $\mu$m and a thickness of about 110 to 300 $\mu$m.

According to this embodiment, the inserted interleaving sheet 147 serves as a slip sheet to improve the slip of the recording media. That is, each recording medium can slide out easily with improved release from the underlying sheet so that feed troubles, such as double sheet feeding or a failure of feeding due to blocking of sheets, can be reduced. Besides, the interleaving sheets 147 are effective in protecting the recording media against scratches.

Figure 28:
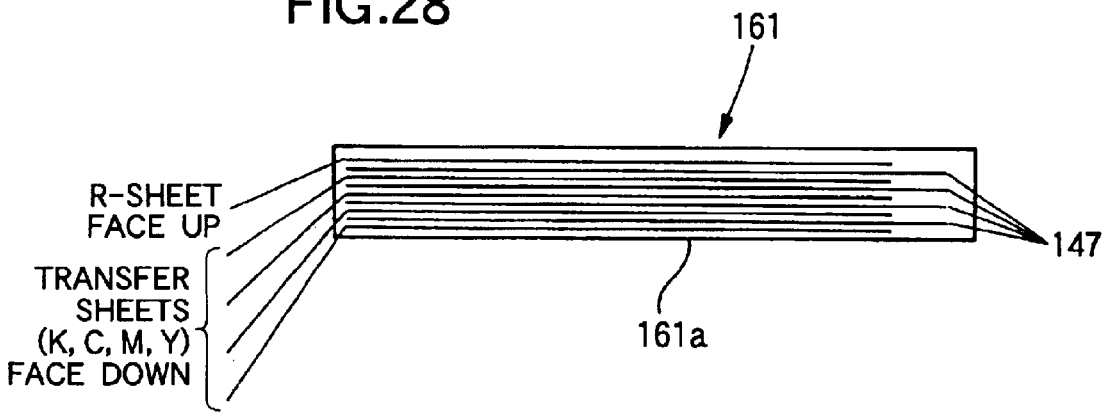
FIG. 28 is a schematic cross-section of a cassette according to a third embodiment of the invention.

A cassette 161 according to a third embodiment of the invention is described by referring to FIGS. 111 and 112. The cassette 161 shown in FIG. 28 has an interleaving sheet 147 inserted between every adjacent sheets of a set of recording media stacked in the cassette body 161*a* in order of feed to the rotating drum 123 (e.g., in order of RKCMY), each interleaving sheet 147 extending from at least one edge of the set of recording media.

According to this embodiment, the interleaving sheets 147 can be fixed at their extended part (extension) to the cassette body 161*a*. Being fixed, the interleaving sheets 147 can be prevented from coming out when the recording media are fed. The interleaving sheet 147 does not need to extend over the whole length of the side of the set. An extension from part of the side length enough to be fixed would suffice for the intended purpose.

Figure 29:
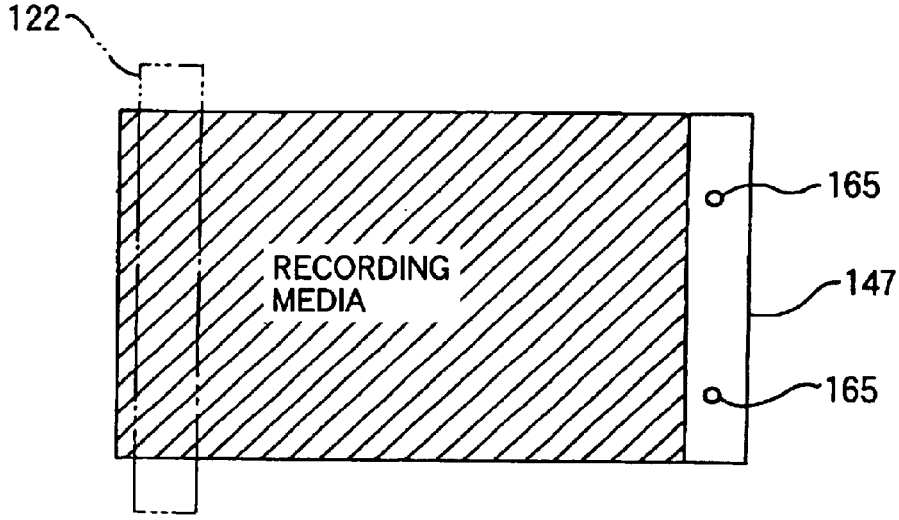
FIG. 29 is a plan view of a set of recording media having interleaving sheets extending from the side opposite to the side where a pickup mechanism of a recording apparatus is applied.

As shown in FIG. 29, the interleaving sheets 147 preferably extend from the side of the set of recording media which is opposite to the side where the pickup mechanism 122 of the recording apparatus 121 is applied. In this case, the extension can easily be fixed to the cassette body 161*a* by, for example, clipping. In this way, the interleaving sheets 147 are prevented from being drawn out together with a recording medium by the force of the pickup mechanism 122.

The interleaving sheet 147 preferably has at least one perforation 165 for fixing the interleaving sheet 147 to the cassette body 161*a*. In this case, the interleaving sheets 147 can be easily and securely fixed to the cassette body 161*a* by a fixing means (not shown) provided on the cassette body 161*a*.

Figure 30:
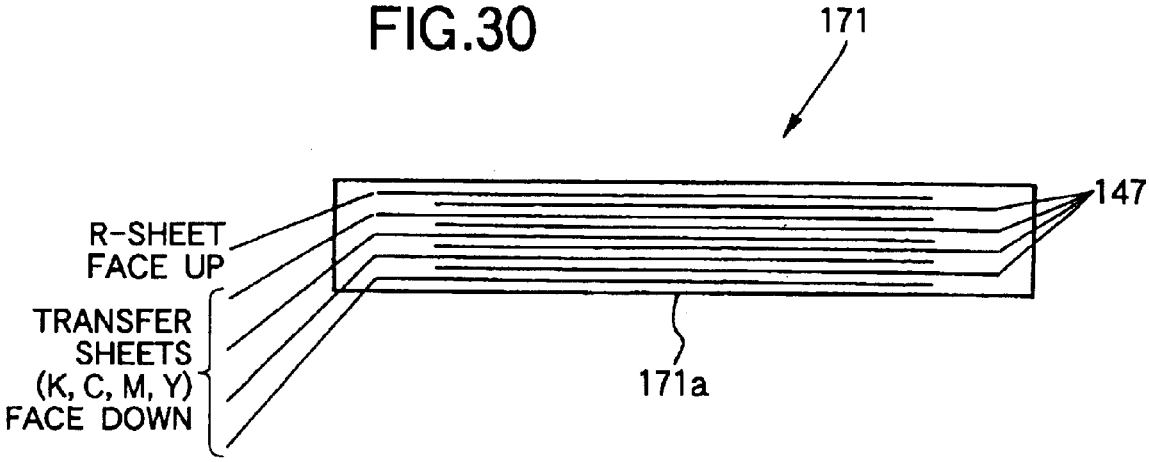
FIG. 30 is a schematic cross-section of a cassette according to a fourth embodiment of the invention.

A cassette 171 according to a fourth embodiment of the invention is described by referring to FIGS. 113 to 115. The cassette 171 shown in FIG. 30 contains recording media stacked in order of feed to the rotating drum 123 (e.g., in order of RKCMY) with an interleaving sheet 147 inserted in every adjacent recording media, each recording medium sticking out from the interleaving sheet 147 in the side to be brought into contact with the pickup mechanism 122.

Figure 31:
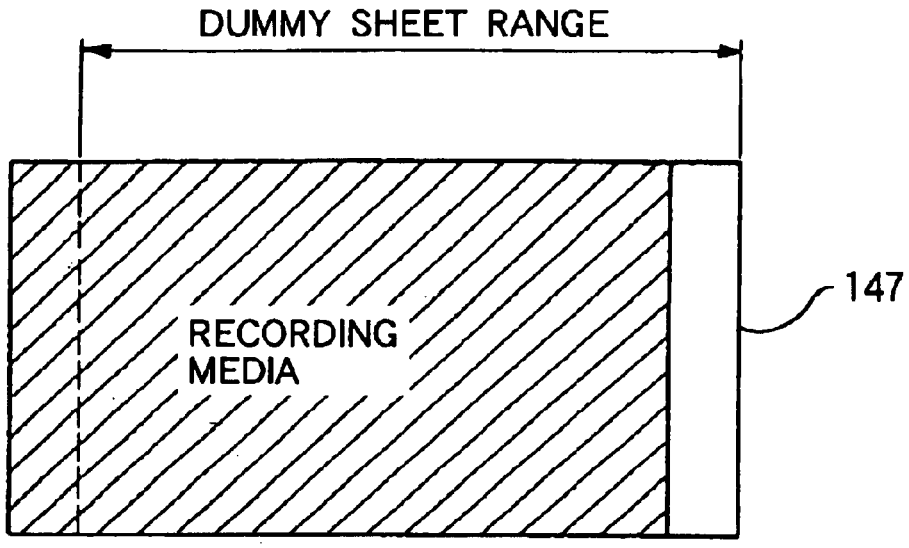
FIG. 31 is a plan view of a set of recording media having interleaving sheets, in which the recording media stick out on one side of the set while the interleaving sheets stick out on the other side.
Figure 32:
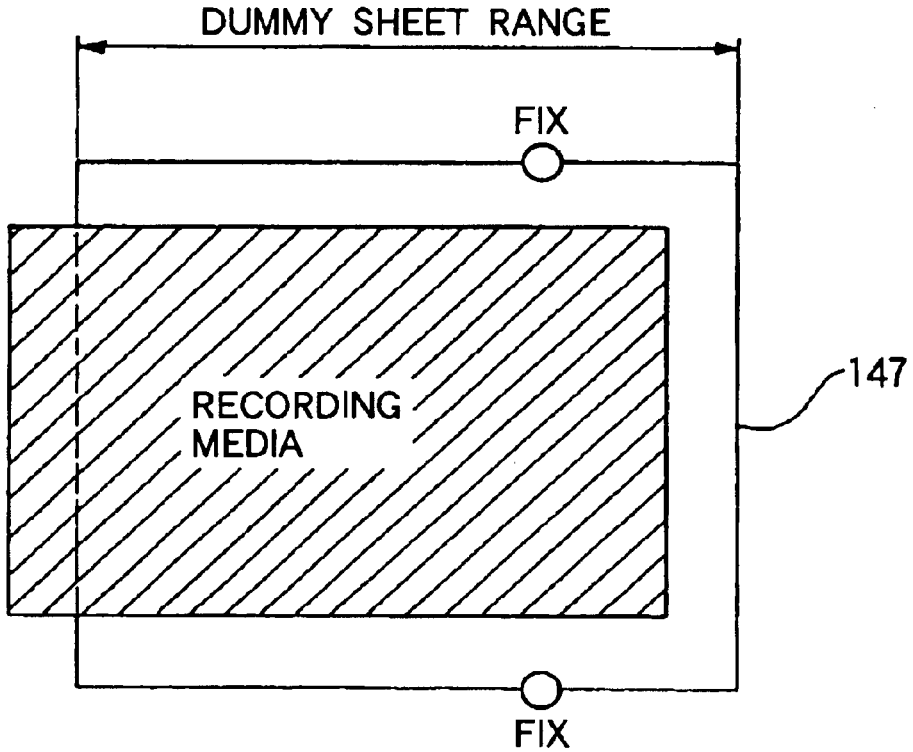
FIG. 32 is a plan view of a set of recording media in which interleaving sheets extend outward from three sides of the set.

According to the fourth embodiment, when the pickup mechanism 122 of the recording apparatus 121 comes into contact with the end of the uppermost recording medium to drag out the recording medium, there is no interleaving sheet 147 right under the pressing member of the pickup mechanism 122 (see FIG. 29). Therefore, the rotational force and the pressing force of the pickup mechanism 122 are exerted only to the uppermost recording medium. As a result, the interleaving sheet 147 underneath the recording medium is securely prevented from being dragged together with that recording medium.

Where the recording media and the interleaving sheets 147 have the same size, it naturally follows that the interleaving sheets 147 stick out from the side opposite to the side where the recording media stick out as shown in FIG. 31. The side from which the interleaving sheets 147 extend or stick out is not limited to the pickup mechanism 122 side. For example, the interleaving sheets 147 may extend from both side edges (the sides parallel to the moving direction of the recording media) as shown in FIG. 32. In this case, the interleaving sheets 147 may be fixed to the cassette body 171*a* at the side extensions.

Figure 33:
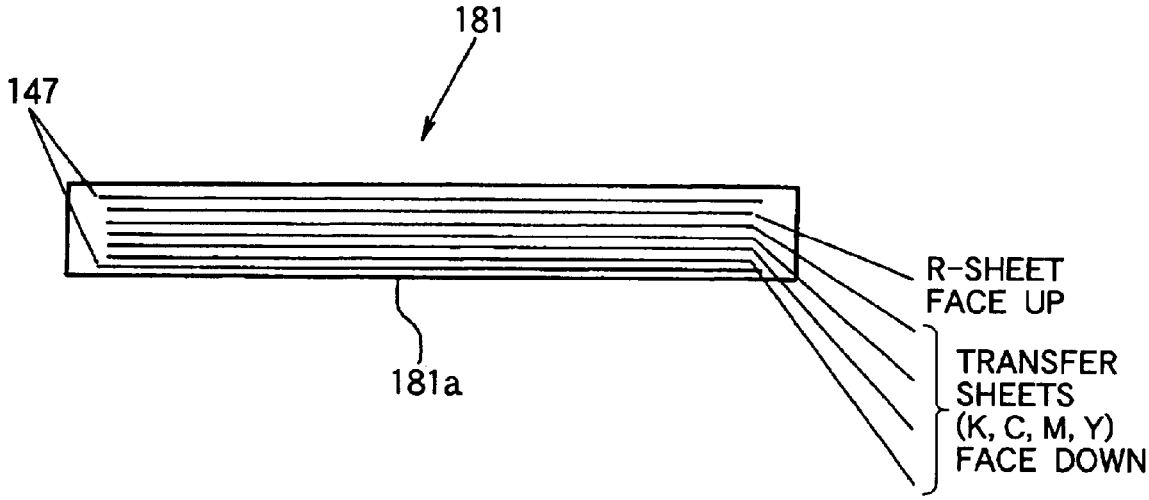
FIG. 33 is a schematic cross-section of a cassette according to a fifth embodiment of the invention.

A cassette 181 according to a fifth embodiment of the invention is shown in FIG. 33. The cassette 181 has a set of recording media stacked in order of feed to the rotating drum 123 (e.g., in order of RKCMY) and also contains an interleaving sheet 147 between the uppermost layer, i.e., the image-receiving layer 131*c* of the image-receiving sheet 131 and the cassette body 181*a* and between the lowermost layer, i.e., the toner layer 133*c* of the lowermost transfer sheet 133 and the cassette body 181*a*. The image-receiving layer 131*c* of the image-receiving sheet 131 and the toner layer 133*c* of the lowermost transfer sheet 133 are thus prevented from direct contact with the cassette body 181*a*. As a result, the image-receiving layer 131*c* and the toner layer 133*c* are protected from undergoing changes in physical or performance properties due to contact with the inner side of the cassette body 181*a*.

Figure 34:
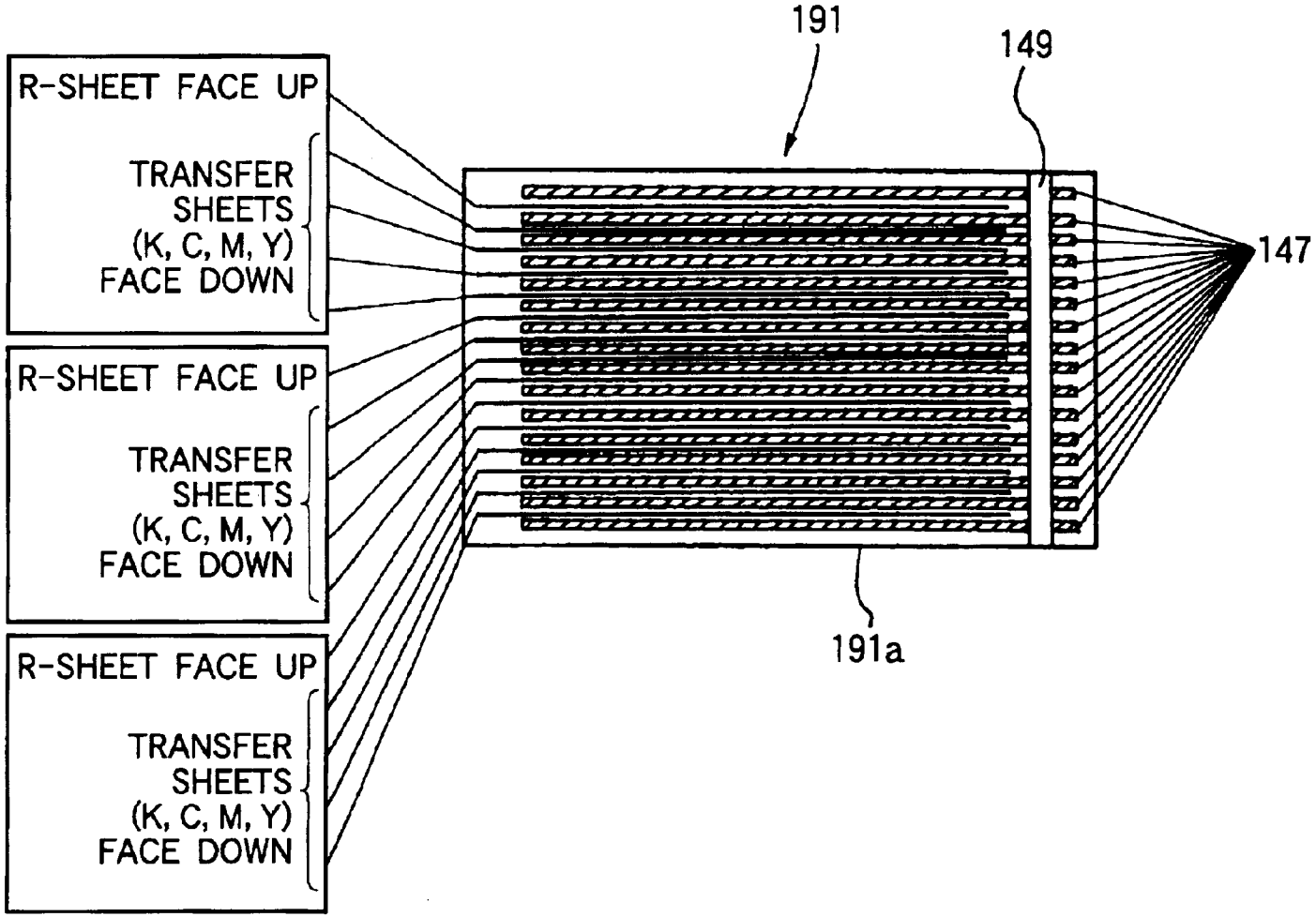
FIG. 34 is a schematic cross-section of a cassette according to a sixth embodiment of the invention.

A cassette 191 shown in FIG. 34 represents a sixth embodiment of the invention, which embraces the characteristics of the above-described first to fifth embodiments of the invention. Specifically, the cassette 191 contains a plurality of sets of recording media, the recording media in each set being stacked in order to feed to the rotating drum 123. An interleaving sheet 147 is inserted between every adjacent recording media. The interleaving sheets 147 extend outward from at least one side of the recording media. The cassette body 191*a* has a fixing member 149 for fixing the extension of the interleaving sheets 147. The fixing member 149 can be at least one upstanding pin provided in the cassette body 191*a*. In this case, the interleaving sheets 147 have at least one perforation in their extension through which the pin pierces to fix the interleaving sheets 147. The fixing member 149 may be such that the interleaving sheets 147 are clipped thereby.

By means of the fixing member 49, the interleaving sheets 147 are fixed to the cassette body 191*a*. Being fixed, the interleaving sheets 147 can be prevented from coming out when the recording media are fed. The interleaving sheet 147 does not need to extend over the whole length of the side of the set. An extension from part of the side length enough to be fixed would suffice.

While not shown in FIG. 34, a cushioning material is disposed on the inner surface of the cassette body 191*a* so as to restrain the recording media's movement in the cassette body 191*a*. The cushioning material is preferably provided between the cassette body 191*a* and the interleaving sheet 147 placed on the top recording medium and between the cassette body 191*a* and the interleaving sheet 147 placed on the bottom recording medium. Dust-free sponge which hardly generates dust is preferably used as a cushioning material.

Figure 35:
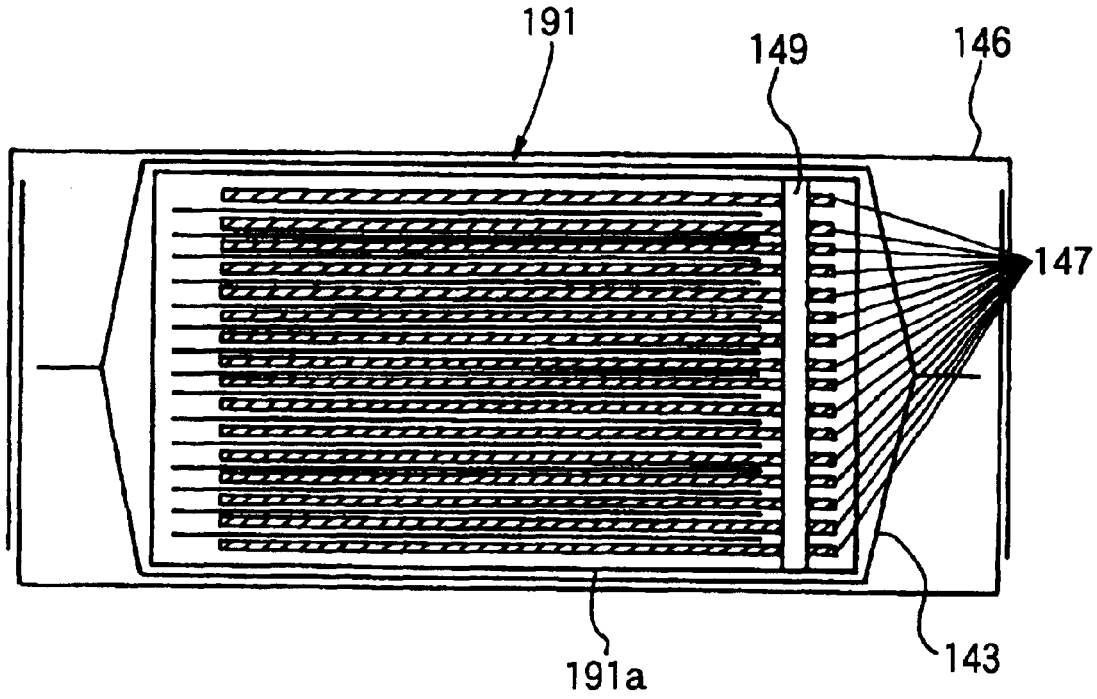
FIG. 35 is a schematic cross-section of a package of the cassette shown in FIG. 34.

The cushioning material restrains or relaxes the recording media's movement in the cassette body 191*a* through inertia during transportation. It prevents friction and direct contact of the recording media with the cassette body 191*a* to protect the recording media against scratches or contamination with dust that may be produced due to friction, etc. Where dust-free sponge is used as a cushioning material, dusting from the cushioning material is minimized. By using such an elastic cushioning material, the cushioning material can be disposed between the cassette body 191*a* and the interleaving sheets 147 in an appropriate compressed state thereby to protect the recording media against damage from shocks As shown in FIG. 35, the cassette 191 containing a stack of recording media is vacuum-packed in an external packaging sheet 143 (hereinafter also referred to as a packaging material), such as a bag of a synthetic resin, (e.g., polyethylene), and the package is put into a container, such as a paperboard box 146.

Being packaged in the packaging material 43, the cassette 191 shuts off dust, light, etc. from the outside. As a result, the recording media are protected against adhesion of dust, denaturation of the working layers (i.e., the image-receiving layer 131*c* and the toner layers 133*c*), and the like and maintain satisfactory quality for an extended period of time. Where the cassette 191 packaged in the packaging material 143 is further packaged in the paperboard box 46, the packaging material 143 and the inside cassette 191 are protected from physical damage. Further, even where the cassette body 191*a* itself has an irregular shape with projections, etc., the paperboard boxes having a rectangular parallelopipedonal shape, etc. are easy to stack up, which improves transportability and space utility.

Since the preset cassette of the present invention has recording media stacked in order of feed to a recording medium holding member of a recording apparatus, the recording apparatus can be loaded with the necessary recording media all at once as a set simply by fitting the cassette to the recording apparatus. There is no need to manually set recording media one by one on a recording apparatus. As a result, the possibility of each recording medium's being contaminated with foreign matter is reduced to reduce resultant image defects. Further, a recording failure due to a wrong stacking order of recording media never occurs. The cassette also brings about saving of labor for making a set of recording media and fixing the set on a recording apparatus.

By use of the recording apparatus according to the present invention, a recording medium feed cassette containing recording media stacked in order of feed to a recording medium holding member can be directly fitted to a feed zone without touching the recording media. As a result, contamination of the recording media with foreign matter is minimized to produce defect-free, high-quality images. Human errors of making a set of recording media in a wrong order are excluded. Since a plurality of sets of recording media can be set at once, the labor can be saved.

What is claimed is:

1. A package comprising at least one set of stacked recording media including an image-receiving sheet having an image-receiving layer which is fed to a recording medium holding member and a plurality of transfer sheets each having a toner layer which are successively fed to the recording medium holding member so that the toner layer of each transfer sheet may be brought into contact with the image-receiving layer of the image-receiving sheet, said image-receiving sheet and said transfer sheets being stacked in order of feed to the recording medium holding member, wherein an interleaving sheet is inserted between every adjacent recording media, wherein each of said interleaving sheets extends outward from at least one side of said set of recording media, and wherein each of said interleaving sheets has at least one perforation in the extension thereof, and said interleaving sheet is fixed to a recording apparatus by making use of said perforation.

2. A package according to claim 1, wherein the top sheet of said set of stacked recording media is said image-receiving sheet.

3. A package according to claim 2, which contains a plurality of said sets of stacked recording media.

4. A package according to claim 3, wherein said image-receiving layer of said image-receiving sheet and said toner layer of each of said transfer sheets face in opposite directions.

5. A package according to claim 1, wherein an interleaving sheet is inserted between said packaging material and said image-receiving layer of said image-receiving sheet which is the uppermost sheet of said set or between said packaging material and said toner layer of the lowermost transfer sheet.

6. A package according to claim 1, wherein said interleaving sheet is made of the same material as the substrate of said recording media.

7. A package according to claim 1, wherein at least the side of said interleaving sheet that is in contact with said recording media has the same properties or conditions as the side of said recording media opposite to said image-receiving layer or said toner layer.

8. A feed cassette comprising a cassette body and preset recording-media containing a set of stacked recording media including an image-receiving sheet having an image-receiving layer which is fed to a recording medium holding member and a plurality of transfer sheets each having a toner layer which are successively fed to the recording medium holding member so that the toner layer of each transfer sheet may be brought into contact with the image-receiving layer of the image-receiving sheet, said image-receiving sheet and said transfer sheets being stacked in an order of feeding to the recording medium holding member, wherein an interleaving sheet is inserted between said cassette body and the image-receiving layer of said image-receiving sheet which is the uppermost sheet of said set and between said cassette body and the toner layer of the lowermost transfer sheet, wherein said interleaving sheets extend outward from at least one side of said set of recording media, and wherein said interleaving sheet extends outward from the side of said set of recording media opposite to the side where a pickup mechanism of a recording apparatus is applied.

9. A feed cassette according to claim 8, which contains a plurality of the sets of stacked recording media.

10. A feed cassette according to claim 9, wherein said image-receiving layer of said image-receiving sheet and said toner layer of each of said transfer sheets face in opposite directions.

11. A feed cassette according to any one of claims 8 to 10, wherein an interleaving sheet is inserted between every adjacent recording media.

12. A recording medium feed cassette according to claim 8, wherein a cushioning material for restraining movement of the recording media in the cassette body is interposed between said interleaving sheet and the cassette body.

13. A recording medium feed cassette according to claim 12, wherein said cushioning material is dust-free sponge.

14. A recording medium feed cassette according to claim 8, wherein said cassette body is made of metal.

15. A recording medium feed cassette according to claim 8, wherein said cassette body is made of paperboard.

16. A recording medium feed cassette according to claim 8, wherein said cassette body is packaged in an external packaging sheet.

17. A recording medium feed cassette according to claim 16, wherein said cassette body packaged in an external packaging sheet is further packaged in a paperboard box.

18. A recording medium feed cassette according to claim 8, wherein said cassette body has an opening through which each recording medium is picked up and fed, said opening is covered with a lid such that the opening is closed and opened.

19. A recording medium feed cassette according to claim 18, wherein said lid is detachable from and attachable to the cassette body.

20. A feed cassette comprising a cassette body and preset recording-media containing a set of stacked recording media including an image-receiving sheet having an image-receiving layer which is fed to a recording medium holding member and a plurality of transfer sheets each having a toner layer which are successively fed to the recording medium holding member so that the toner layer of each transfer sheet may be brought into contact with the image-receiving layer of the image-receiving sheet, said image-receiving sheet and said transfer sheets being stacked in an order of feeding to the recording medium holding member, wherein an interleaving sheet is inserted between said cassette body and the image-receiving layer of said image-receiving sheet which is the uppermost sheet of said set and between said cassette body and the toner layer of the lowermost transfer sheet, wherein said interleaving sheets extend outward from at least one side of said set of recording media, and wherein said recording media stick out from the side of said interleaving sheets where a pickup mechanism of a recording apparatus is applied.

21. A feed cassette comprising a cassette body and preset recording-media containing a set of stacked recording media including an image-receiving sheet having an image-receiving layer which is fed to a recording medium holding member and a plurality of transfer sheets each having a toner layer which are successively fed to the recording medium holding member so that the toner layer of each transfer sheet may be brought into contact with the image-receiving layer of the image-receiving sheet, said image-receiving sheet and said transfer sheets being stacked in an order of feeding to the recording medium holding member, wherein an interleaving sheet is inserted between said cassette body and the image-receiving layer of said image-receiving sheet which is the uppermost sheet of said set and between said cassette body and the toner layer of the lowermost transfer sheet, wherein said interleaving sheets extend outward from at least one side of said set of recording media, and wherein said cassette body has a member for fixing the extension of the interleaving sheets.

22. A recording apparatus comprising a recording medium holding member which moves while holding a recording medium thereon and a recording head which moves in the direction perpendicular to the moving direction of said recording medium holding member while irradiating said recording medium with a laser beam spot, wherein said recording apparatus has a cassette holder which supports a recording medium feed cassette containing at least one set of preset recording media stacked in order of feed to said recording medium holding member, said recording media being fed from said recording medium feed cassette mounted on said cassette holder to said recording medium holding member, wherein an interleaving sheet is inserted between said recording medium feed cassette and an image receiving layer of an image-receiving sheet which is the uppermost sheet of said at least one set of preset recording media and between said recording medium feed cassette and a toner layer of a transfer sheet which is the lowermost sheet of said at least one set of preset recording media, wherein said interleaving sheets extend outward from at least one side of said at least one set of preset recording media, and wherein said recording medium feed cassette has a member for fixing the extension of the interleaving sheets.

* * * * *